US006673003B2

(12) United States Patent
Harnish

(10) Patent No.: US 6,673,003 B2
(45) Date of Patent: Jan. 6, 2004

(54) VACUUM CLEANING FOLDING RAIL

(75) Inventor: David Alan Harnish, Maysville, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 203 days.

(21) Appl. No.: 09/852,187

(22) Filed: May 9, 2001

(65) Prior Publication Data

US 2002/0169061 A1 Nov. 14, 2002

(51) Int. Cl.[7] ..... B08B 5/04

(52) U.S. Cl. ..... 493/418; 493/429; 493/436; 493/450; 493/446; 493/438

(58) Field of Search ..... 493/418, 429, 493/436, 450, 446, 438; 83/152

(56) References Cited

U.S. PATENT DOCUMENTS

| | | | | |
|---|---|---|---|---|
| 2,082,411 A | * | 6/1937 | Merrill | 101/423 |
| 2,818,595 A | * | 1/1958 | Rosewall | 15/309.1 |
| 3,111,310 A | | 11/1963 | Dutro | |
| 3,800,359 A | * | 4/1974 | Howard et al. | 15/37 |
| 4,131,271 A | | 12/1978 | Slawny | |
| 4,321,051 A | | 3/1982 | Hajek et al. | |
| 4,421,501 A | * | 12/1983 | Scheffer | 493/439 |
| 4,454,621 A | * | 6/1984 | Testone | 15/1.51 |
| 4,835,808 A | * | 6/1989 | Hahne et al. | 15/1.51 |
| 4,994,010 A | | 2/1991 | Doderer-Winkler | |
| 5,027,462 A | | 7/1991 | Kunzig et al. | |
| 5,094,658 A | | 3/1992 | Smithe et al. | |
| 5,291,628 A | * | 3/1994 | Thayer | 15/306.1 |
| 5,453,926 A | | 9/1995 | Stroschin et al. | |
| 5,558,318 A | | 9/1996 | Crowley et al. | |
| 5,596,783 A | * | 1/1997 | Testone | 15/1.51 |
| 5,609,084 A | * | 3/1997 | Gronbjerg | 83/100 |
| 5,779,616 A | | 7/1998 | Hintermeier et al. | |
| 5,904,277 A | * | 5/1999 | Niedermeyer | 223/1 |
| 6,210,309 B1 | | 4/2001 | Smithe et al. | |

FOREIGN PATENT DOCUMENTS

| | | |
|---|---|---|
| DE | 1142879 | 1/1963 |
| DE | 2240397 | 2/1974 |
| GB | 862296 | 3/1961 |
| GB | 1413124 | 11/1975 |

* cited by examiner

*Primary Examiner*—Rinaldi I. Rada
*Assistant Examiner*—Brian Nash

(57) ABSTRACT

An elongate rail for an equal path folder that has a hollow tube having a a longitudinal axis and a vacuum applied thereto, and a first and second substantially planar surfaces parallel to the longitudinal axis and forming a folding edge therebetween. The hollow tube has at least one opening positioned angularly away from both the first and the second surfaces. The vacuum causes a negative pressure to be applied to the opening so that a web substrate passing over the first and second surfaces has at least a portion of the vacuum applied to a face of the web substrate when the web substrate is proximate to at least one of the first and second surfaces thereby substantially reducing particulate matter build-up on the folding equipment and substantially reducing the undesirabie particulate matter left on the out-going web product.

17 Claims, 19 Drawing Sheets

VACUUM CLEANING FOLDING RAIL

FIELD OF THE INVENTION

The present invention relates to a vacuum cleaning folding rail for folding a stock web substrate, more particularly, a vacuum cleaning folding rail for the paper making industry for supplying a vacuum to remove loose matter from a web substrate under tension during folding.

BACKGROUND OF THE INVENTION

Equipment for completing folds in high-speed web processes are well known in the art. Folding formers, folding plates, and "V"-folders are machined and polished sheet metal elements over which a web substrate is guided. A typical "V"-folder would consist of a generally triangular structure that would include a substantially trapezoidal folding plate surface that initially receives the moving web substrate. A folding plate is a generally flat surface with a pair of spaced-apart converging edges. A substantially trapezoidal transition nose surface is contiguous to and merges smoothly with the surface of the fold plate, forming an oblique angle therewith. A folding plate generally has a terminal nose surface contiguous to the transition nose surface and merges smoothly therewith forming an oblique angle with it. The terminal nose portion terminates in a point that defines the location of the fold.

However, when a web substrate passes over such a folding plate structure, the process of folding imparts work to the web substrate and results in a drag on the web substrate. The drag and bending of the web substrate may tend to abrade or scrape coating or actual web fiber from the web substrate. This loss of coating or web substrate fibers tends to be cumulative, and over time, a highly packed and dense layer forms on the folding plate surface. This hard-packed layer must be removed physically by scraping, or by chemical treatment. This involves shutting down a line for an indefinite period to allow personnel access and time to remove any packed matter.

Such a folder is shown in Dutro, U.S. Pat. No. 3,111,310. Dutro discloses a complex series of folding plates for making a fold in a web or ribbon of paper. Curved flanges bound the converging edges of the fold plate and transition nose surfaces. A flue is formed integrally within the flanges. Dutro uses conventional folding plate technology resulting in the potential build-up of loose particulate emanating from the web onto the folding plate surface.

German Patent No. DE AS 2,240,397 discloses a former for longitudinally folding paper webs processed in a rotary paper machine having a funnel shaped nose plate and nose. Positive pressure is applied to a passing web substrate, ostensibly to reduce friction. However, contact by the web with the forming plate is still present. Thus, drag is reduced, but not eliminated on nonporous materials causing the build-up of web fiber or web coating onto the folding plate. Loose substrate is not removed and can still build up onto the folding surface.

U.S. Pat. No. 5,094,658 discloses a plowshare folder in an envelope-forming machine where individual envelope blanks are conveyed through the folding mechanism by a vacuum table. The vacuum table includes a series of spaced apart conveyor belts that are driven over the surface of a vacuum table in the feed direction of the blanks. The vacuum table includes a plate having apertures that draw in air as a result of a vacuum created by the evacuation of air from a vacuum plenum created below the surface of the vacuum plate. The plowshare folder includes a thin wall of rigid material having at the front end an initial planar surface that gradually bends in a 180° turn. Through the 180° turn, blades of the plowshare engage the seal flap region of the envelope blank. The flaps to be folded extend parallel to the axis of movement of the blank across the vacuum table and are folded into overlying relation with the main body of the blank.

The folding operation in U.S. Pat. No. 4,994,010 is performed by a plowshare-type folding mechanism that includes fold loops and folding blades. During the folding operation, the lateral flaps converge and are glued together in an overlapping area by means of an adhesive layer that has been previously applied with the result that the folded and overlapping flaps form the backside of the envelope. The lateral flaps are simultaneously folded by folding blades that have an inner curvature that evolves from an initial point where the side flaps extend horizontally to a point where the flaps are folded in a tubular configuration. The guide surfaces of the folding blades curve progressively through 180° along travel of the blank.

Similarly, other patents show the use of folding plates in various configurations. However, none seek to remove loose substrate or coating from the passing web. Exemplary patents include: German Patent Nos. DE AS 1,142,878 and DE AS 2,163,408, English Patent GB 862,296, and U.S. Pat. Nos. 4,131,271; 4,321,051; and 5,779,616.

Accordingly, it would be desirable to provide a device for folding a web substrate that minimizes web line cleaning time while providing a high quality finished product.

SUMMARY OF THE INVENTION

In a non-limiting exemplary embodiment of the present invention, an elongate rail for an equal path folder comprises a hollow tube having a longitudinal axis, a proximate and a distal end, and a vacuum applied thereto. The tube has first and second substantially planar surfaces parallel to the longitudinal axis, and forming an edge therebetween. There is at least one opening in the rail angularly positioned away from the first and said second surfaces. The vacuum causes a negative pressure to be applied to the opening so that web substrate, under tension, such as various paper type materials and the like as well as various types of plastic web materials which are capable of longitudinal movement, passing over the first and second surfaces has at least a portion of the vacuum applied to a surface of the web when the web is proximate to at least one of the first and second surfaces.

In yet another alternative embodiment of the present invention, an elongate rail for an equal path folder comprises a hollow tube having a longitudinal axis, a proximate and a distal end, and a vacuum applied thereto. The tube has a first substantially planar surface parallel to the longitudinal axis, having a protuberance and an opening disposed thereon. The rail has a second substantially planar surface parallel to the longitudinal axis. The first and said second surfaces form an edge therebetween. The vacuum causes a negative pressure to be applied to the opening so that a web substrate passing over the first surface has at least a portion of said vacuum applied to a face of said web substrate when said web substrate is under tension and is proximate to said first surface.

In still another alternative embodiment of the present invention, an equal path folder comprises at least two elongate rails, each rail comprising a hollow tube having a longitudinal axis, a proximal end, a distal end, and a vacuum applied thereto. Each tube has a first and second substantially planar surface parallel to the longitudinal axis, forming an edge therebetween. There is at least one opening in the tube angularly positioned away from the first and second surfaces. The first surface being angularly convergent upon the second surface at the distal end to form an edge therebetween, and, the vacuum causing a negative pressure to be applied to said opening so that a web substrate under tension and passing over the first and second surfaces has at least a portion of said vacuum applied to a face of the web substrate when the web substrate is proximate to at least one of the first and second surfaces. A first of the two elongate rails can be a mirror image of a second of the at least two elongate rails, and, wherein the distal end of the first elongate rail is fixably positioned relative to the distal end of the second elongate rail wherein the distal end of the first elongate rail and the distal end of the second elongate rail form an edge therebetween.

The advantages and novel features of the present invention will become apparent to those skilled in the art from the following detailed description, which simply illustrates various modes contemplated for carrying out the invention. As will be realized, the invention is capable of other different aspects and geometries, all without departing from the scope of the invention. Accordingly, the following drawings and descriptions are illustrative in nature and not restrictive.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings and wherein:

DETAILED DESCRIPTION OF THE INVENTION

The present invention is related to a hollow folding rail that has an internal vacuum and at least one slot, orifice, or hole that allows the internal vacuum to be applied to a passing web substrate. The vacuum allows loose substrate, debris or excess coating to be easily removed by the vacuum. The purpose for removal of loose substrate, debris, or coating from a web substrate prior to folding is not limited to, but includes, the reduction of build-up of loose substrate, debris, or coating on the folding surface that can reduce and degrade the folding surface area. Reduction of the folding surface area can also reduce the total resultant drag to a web substrate moving across a folding surface or through a folding system. Further, the reduction of loose substrate build-up on a folding surface can decrease the resulting down time necessary to remove build-up from the folding surface. Removal of folding surface build-up can require extensive manual effort as well as the serial application of numerous and potentially toxic solvents. Additionally, the removal of surface build-up requires an entire web substrate processing line be shut down at the parent roll stage. Such a shut down results in capital losses, due to the inability to produce an intermediate or an end product during the period of time the processing line is down.

The invention is more generally related to a vacuum cleaning folding rail system wherein a vacuum can be applied prior to the contact of a web substrate with the folding rail or the application of vacuum to the web substrate prior to contact with a folding edge. Application of a vacuum to a web substrate prior to contact with a folding edge consistent with the present invention can further reduce the induced drag on the web substrate caused by such contact. Minimizing web substrate contact area with respect to the folding surface reduces web substrate drag.

The present invention also provides a novel structure for utilizing identical, or non-identical, folding rails for providing a one-half lapped web substrate, or "V"-fold using an "equal path folder." The web substrate is "flat" (i.e., has no longitudinal fold) prior to contact with the equal path folder. Longitudinal folding commences as the web substrate, such as various paper type materials and the like as well as various types of plastic web materials which are capable of longitudinal movement, of width X travels down the equal path folder, also called "web flow", developing the desired fold line while facilitating the un-lapped portion through the proper detours providing a width of X/2, or another fractional portion thereof.

Figure 1:
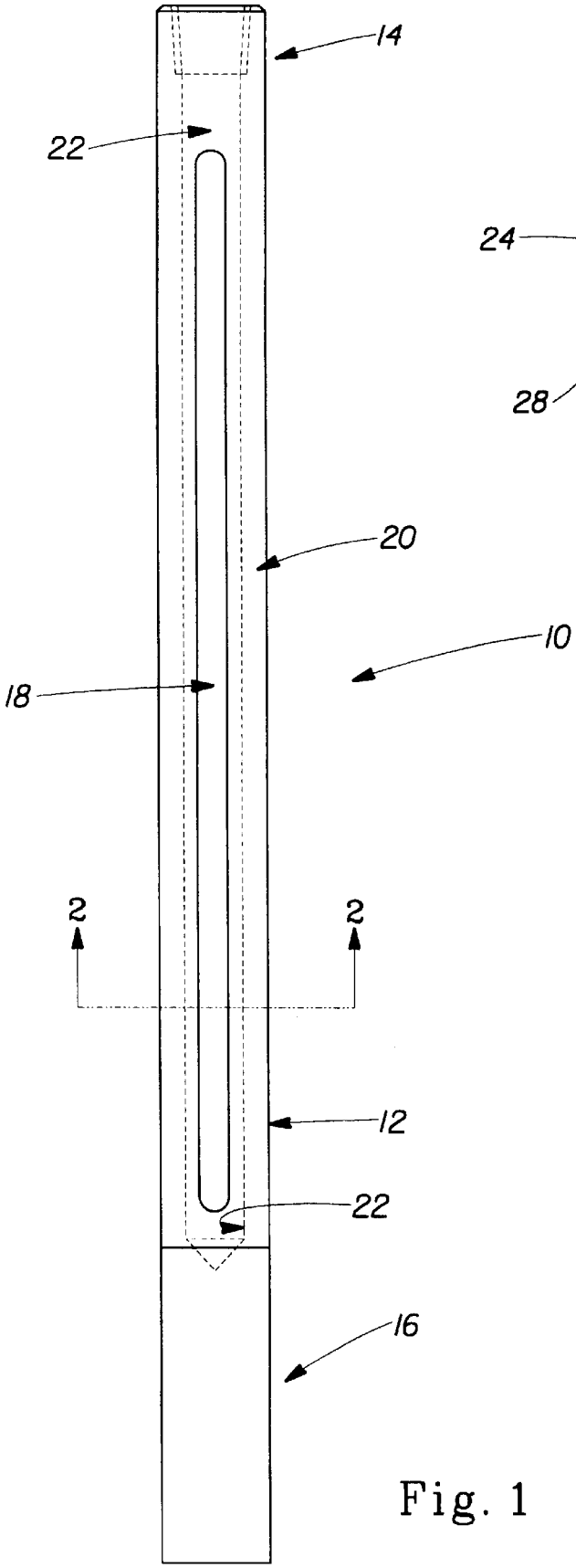
FIG. 1 is a plan view of a preferred embodiment of a vacuum folding rail in accordance with the present invention.
Figure 2:
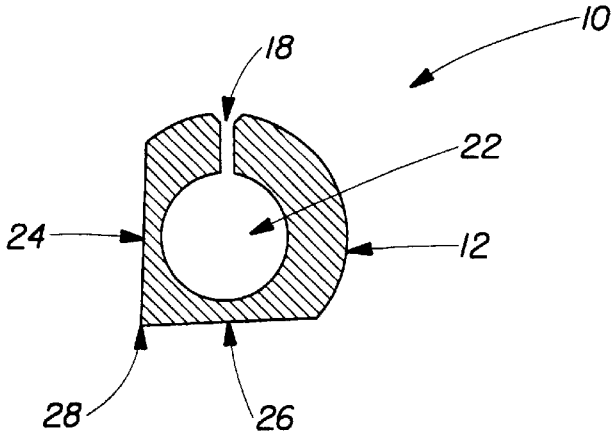
FIG. 2 is a cross-sectional view of the vacuum folding rail of FIG. 1 taken along line 2—2.
Figure 8:
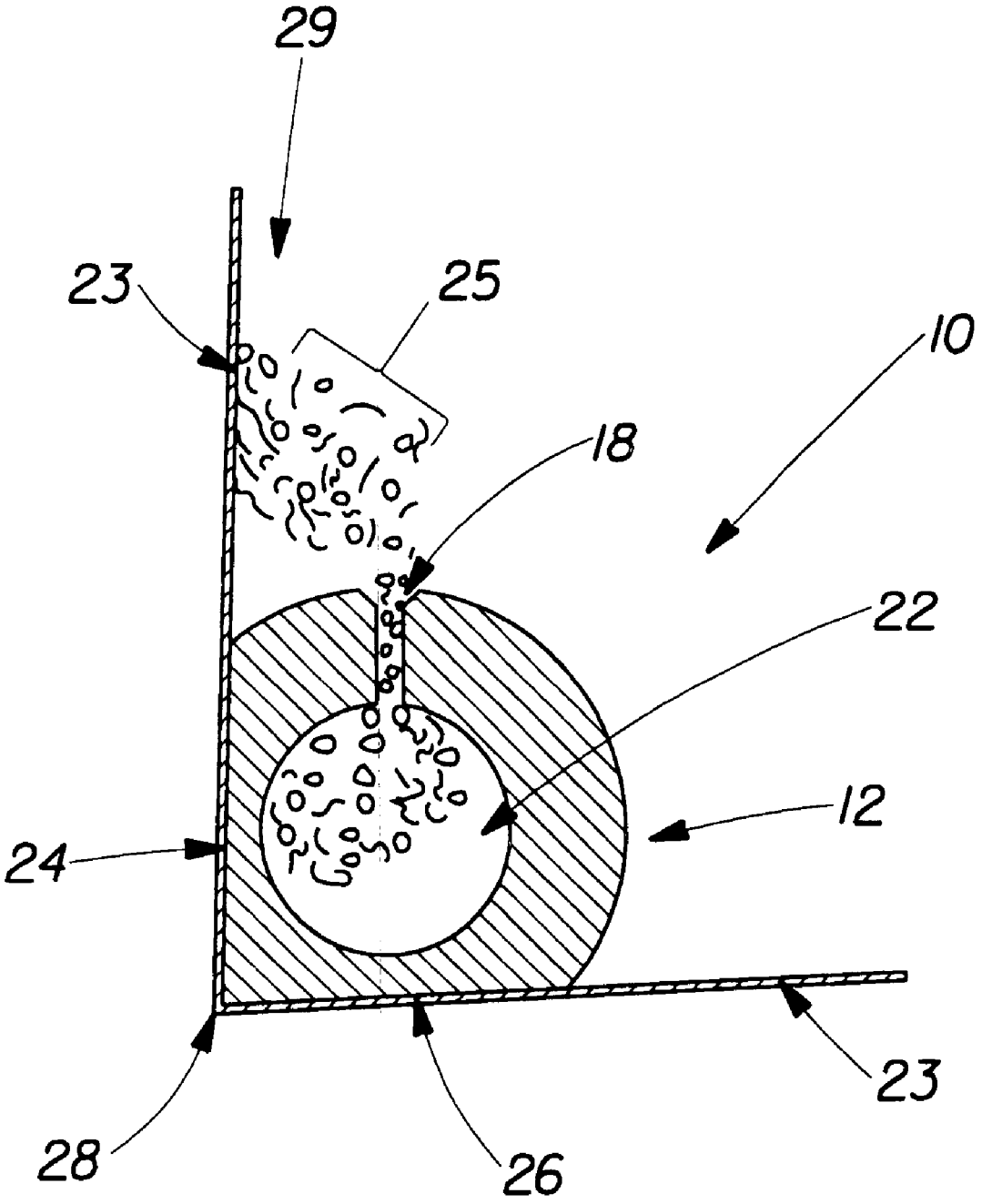
FIG. 8 is a cross-sectional view of the vacuum folding rail of FIG. 1 taken along line 2—2 with a web substrate material being folded in accordance with the present invention with the operational position of the vacuum slot.

FIG. 1 illustrates a folding rail in accordance with the present invention and is labeled generally by the numeral 10. The folding rail includes an elongate tube 12 with a proximal end 14 and a distal end 16. Elongate tube 12 is generally hollow and has a vacuum applied at proximal end 14. Elongate tube 12 has a slot 18 parallel to the longitudinal axis of elongate tube 12 which allows the applied vacuum to cause a negative differential pressure, ΔP, to exist between the outer portion 20 of elongate tube 12 and the inner, hollow portion 22 of elongate tube 12. Elongate tube 12 has a first planar surface 24, as shown in FIG. 2, parallel to the longitudinal axis of tube 12, a second planar surface 26 parallel to the longitudinal axis of tube 12, first and second surfaces 24, 26 form an edge 28 parallel to the longitudinal axis of tube 12 as can be seen in FIG. 2. First planar surface 24, second planar surface 26 and edge 28 can be machined as part of tube 12 or be attachable to tube 12 as would be known to one skilled in the art. Thus, as shown in FIG. 8, a negative differential pressure, ΔP, is applied from hollow portion 22 to web substrate 23 flowing in direction 29 for the removal of particulate matter or loose web substrate 25 from web substrate 23.

Figure 3:
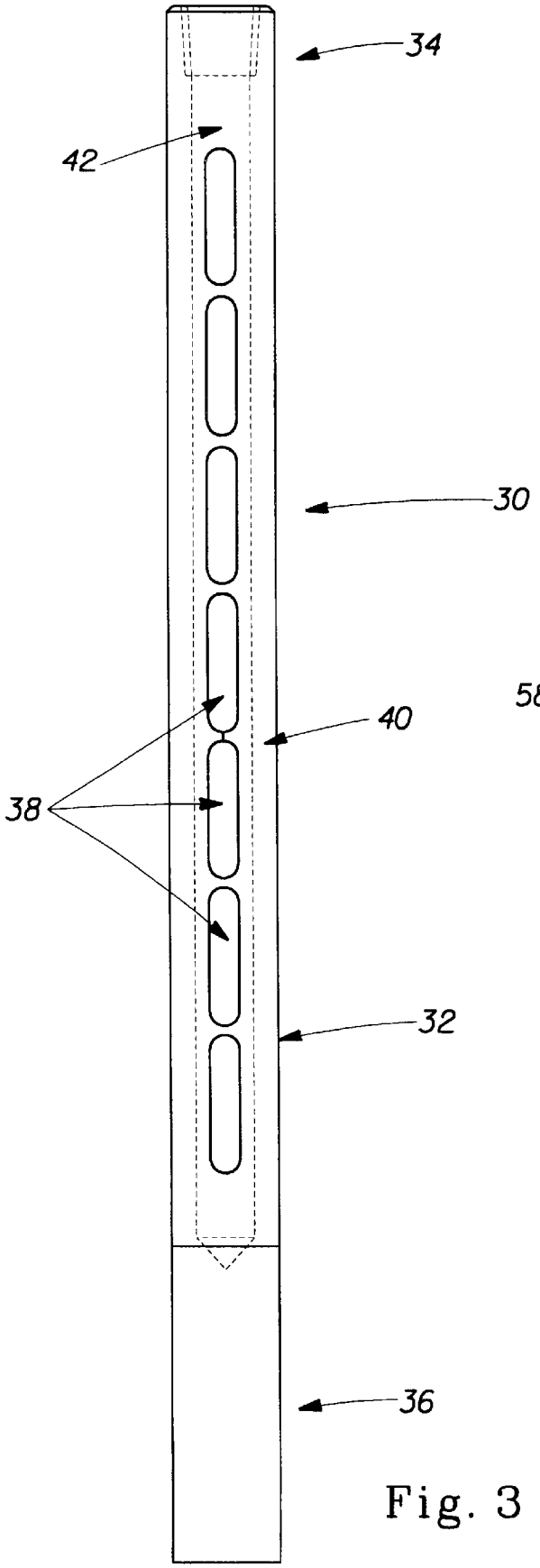
FIG. 3 is a plan view of another embodiment of a vacuum folding rail.

FIG. 3 illustrates a folding rail in accordance with the present invention and is labeled generally by the numeral 30. This folding rail includes an elongate tube 32 with a proximal end 34 and a distal end 36. Elongate tube 32 is generally hollow and has a vacuum applied at proximal end 34. Elongate tube 32 has a series of ovular slots 38 placed parallel to the longitudinal axis of elongate tube 32 which allows the applied vacuum to cause a negative differential pressure, ΔP, to exist between the outer portion 40 of elongate tube 32 and the inner, hollow portion 42 of elongate tube 32.

Figure 4:
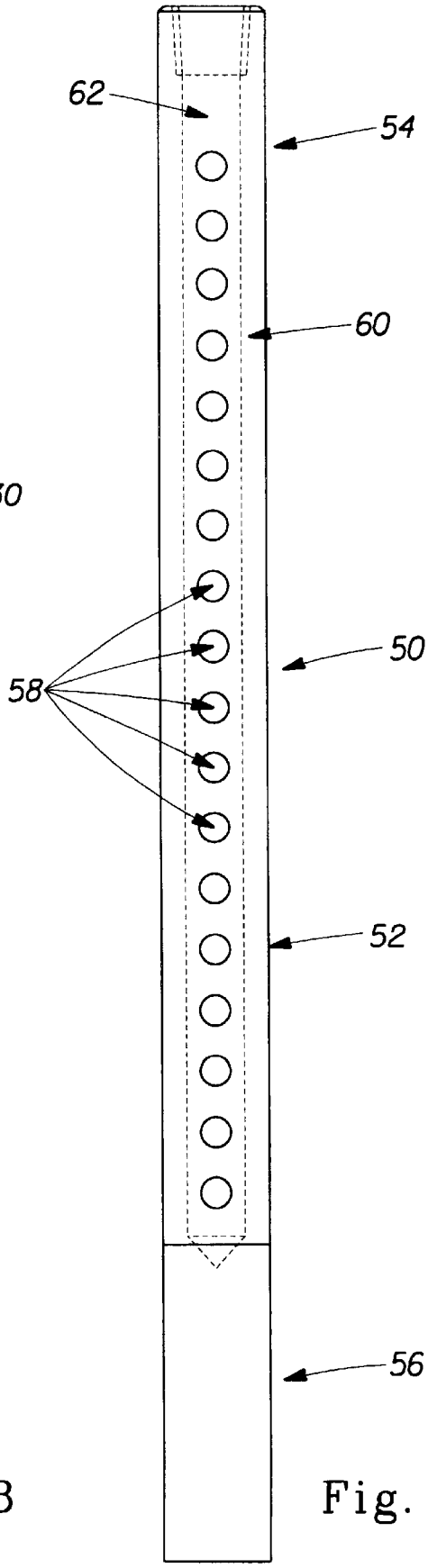
FIG. 4 is a plan view of another embodiment of a vacuum folding rail.

Alternatively, FIG. 4 illustrates a folding rail in accordance with the present invention and is labeled generally by the numeral 50. Folding rail 50 includes an elongate tube 52 with a proximal end 54 and a distal end 56. Elongate tube 52 is generally hollow and has a vacuum applied at proximal end 54. Elongate tube 52 has a series of circular holes 58 through tube 52. Holes 58 can be aligned parallel to the longitudinal axis of generally hollow elongate tube 52 which allows the applied vacuum to cause a negative differential pressure, ΔP, to exist between the outer portion 60 of elongate tube 52 and the inner, hollow portion 62 of elongate tube 52. As non-limiting examples, holes 58 can be tapered, straight-walled, or spiraled.

Figure 5:
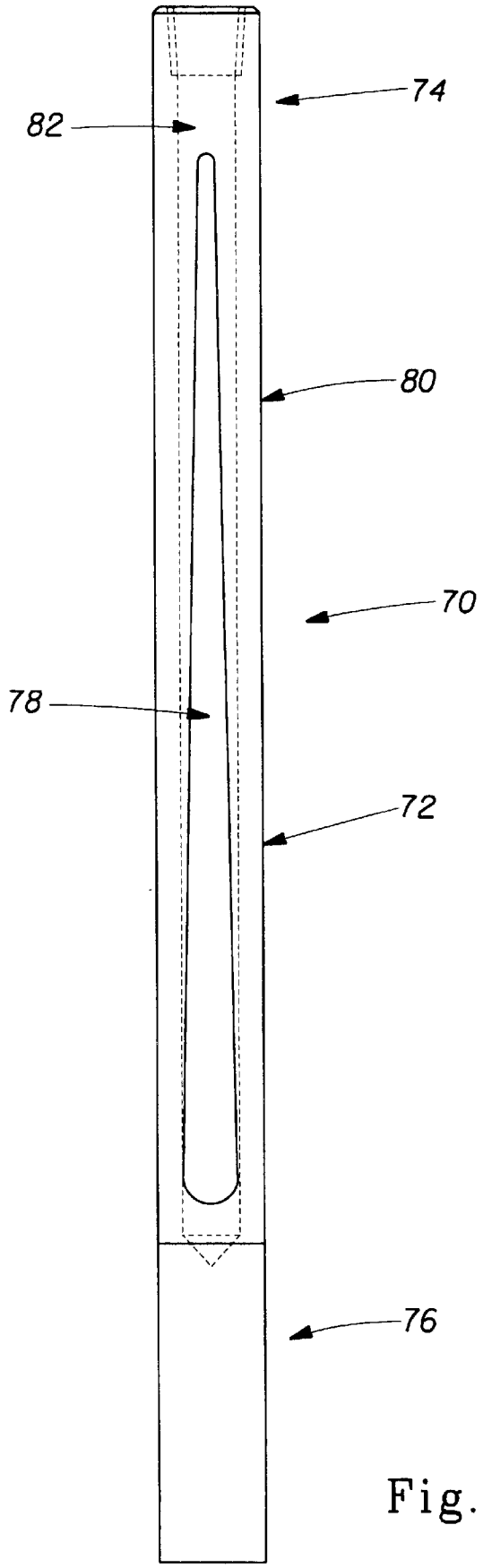
FIG. 5 is a plan view of another embodiment of a vacuum folding rail.

In still another embodiment, FIG. 5 illustrates a folding rail in accordance with the present invention and is labeled generally by the numeral 70. Folding rail 70 includes an elongate tube 72 with a proximal end 74 and a distal end 76. Elongate tube 72 is generally hollow and has a vacuum applied at the proximal end 74. Elongate tube 72 has a tapered slot 78 placed parallel to the longitudinal axis of elongate tube 72 which allows the applied vacuum to cause a negative differential pressure, ΔP, to exist between the outer portion 80 of elongate tube 72 and the inner, hollow portion 82 of elongate tube 72 with varying intensity along the length of the longitudinal axis. As a further non-limiting example, slot 78 may be linear, straight walled, symmetric, or asymmetric.

Figure 6:
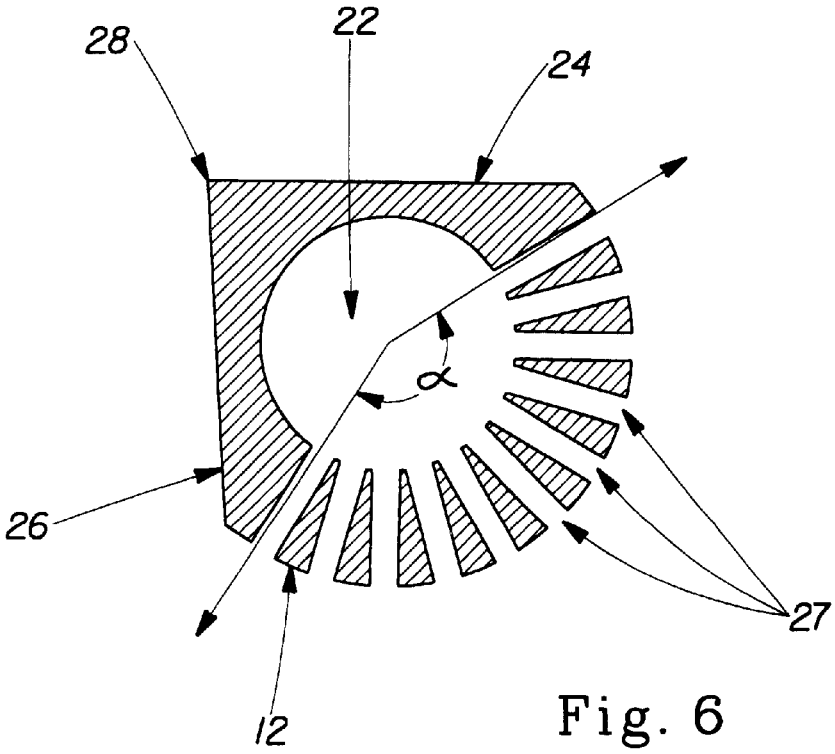
FIG. 6 is a cross-sectional view of another embodiment of a vacuum folding rail.
Figure 7:
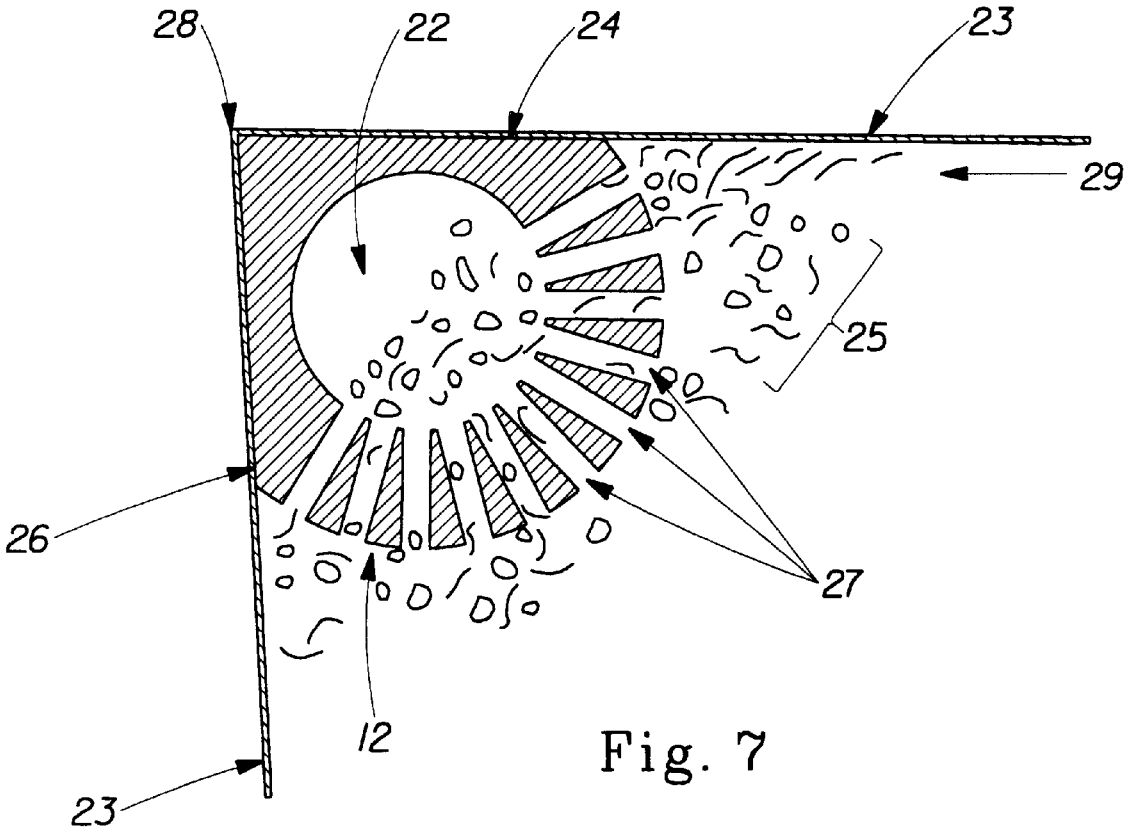
FIG. 7 is the cross-sectional view of the vacuum folding rail FIG. 6 of with a web substrate material being folded in accordance with the present invention detailing multiple operational positions of the vacuum slot.

It will be noted that the slot in any of the present embodiments within the scope of the present invention can be positioned at any angle a relative to first surface 24 and second surface 26 within the hollow tube of any of the embodiments shown in FIGS. 1–5. Such an angular displacement a is representatively shown in FIG. 6. Such an angular displacement, α, of slot 18, can be determined by one skilled in the art to provide the most efficacious removal of dislodgeable matter from a web substrate 23 and can typically range from zero degrees to 180 degrees from the leading edge of first surface 24. Thus, the angular displacement, a, of slot 18 can be determined relative to first surface 24 and second surface 26 prior to contact of web substrate 23 with surface 24. Alternatively, groupings of slots 27 can be arranged by one skilled in the art to provide multiple regions for matter removal or to provide more or less negative differential pressure, ΔP, from hollow portion 22 to web substrate 23 flowing in direction 29 for the removal of particulate matter 25 from web substrate 23 as shown in FIG. 7.

Figure 9:
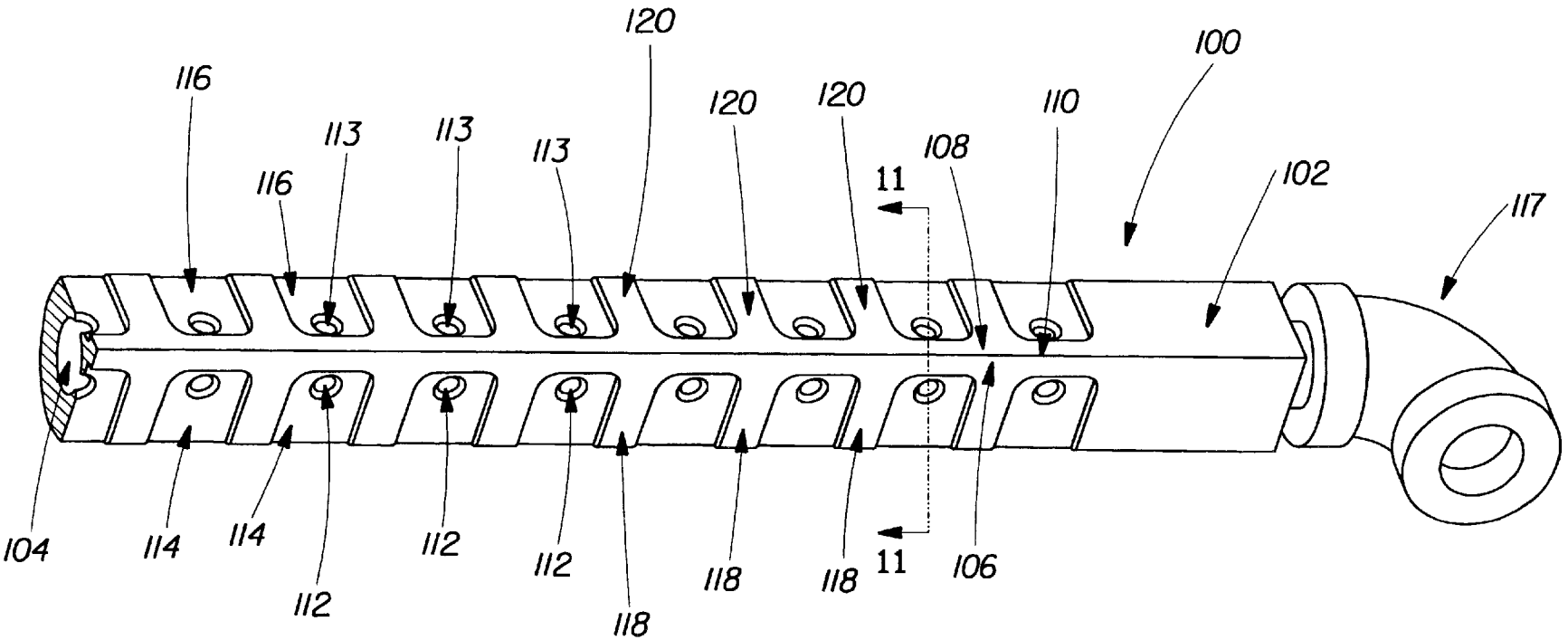
FIG. 9 is a fragmentary perspective view of another embodiment of a vacuum folding rail.
Figure 11:
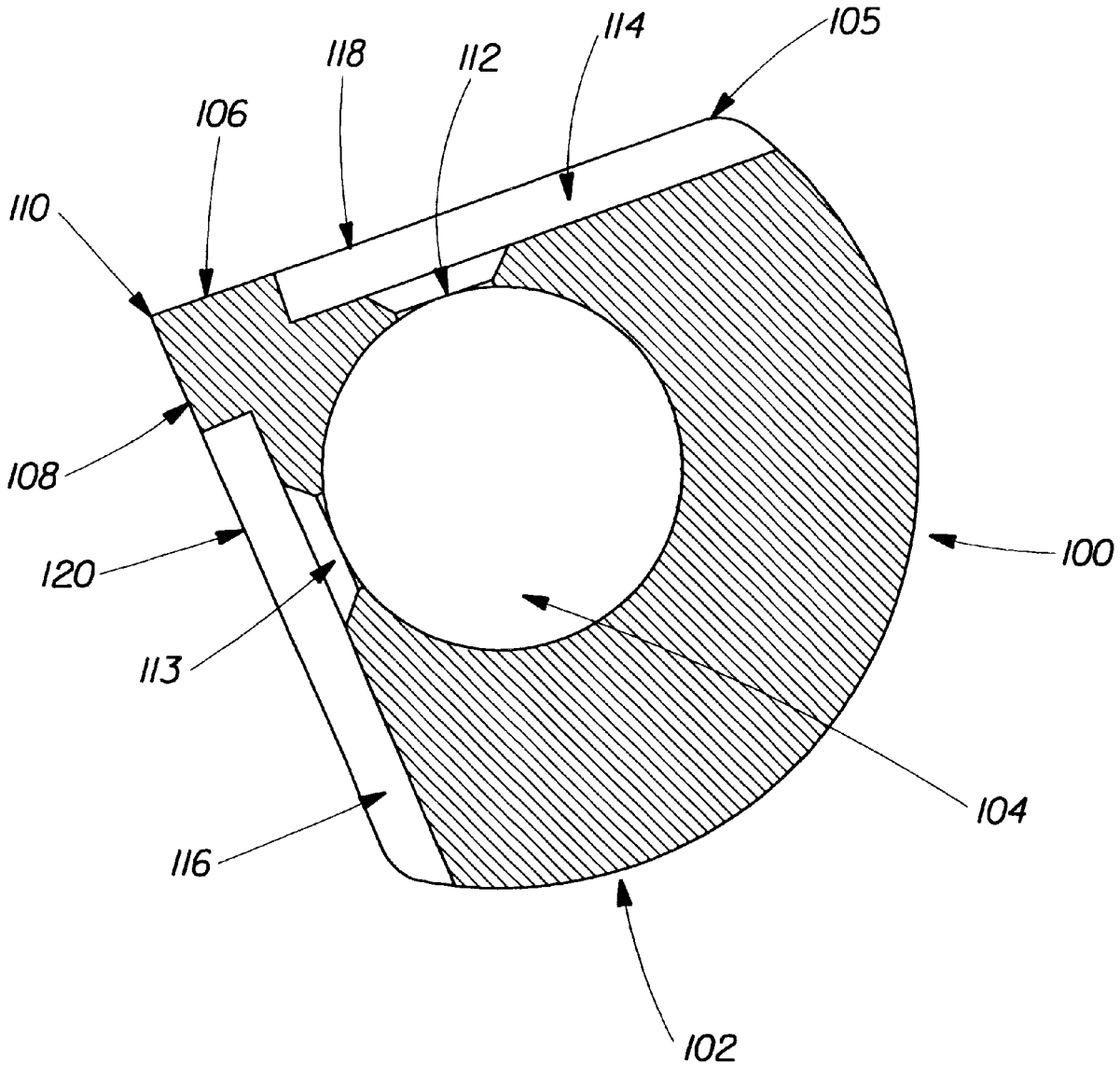
FIG. 11 is a cross-sectional view of the vacuum folding rail of FIG. 9 taken along line 11—11.
Figure 12:
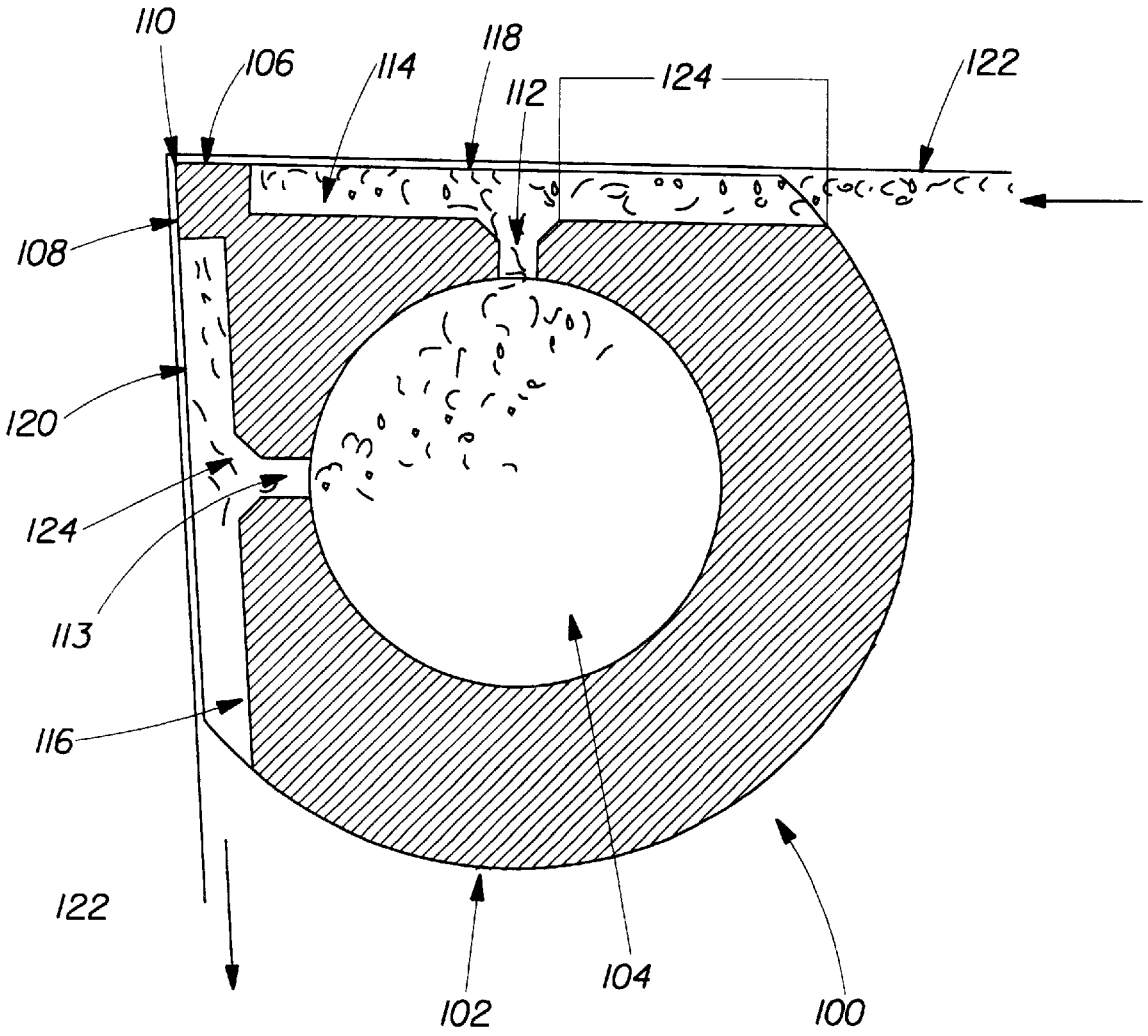
FIG. 12 is a cross-sectional view of the vacuum folding rail of FIG. 9 taken at line 11—11 with a web substrate material being folded in accordance with the present invention showing the operational positions of the vacuum slots.

An alternative embodiment as shown in FIG. 9 shows a fragmentary view of folding rail 100 depicting an elongate tube 102 having a first planar surface 106 parallel to the longitudinal axis of tube 102, a second planar surface 108 parallel to the longitudinal axis of tube 102. "Folding edge" 110 can thereby be created to be parallel to the longitudinal axis of tube 102. First planar surface 106, second planar surface 108 and edge 110 can be machined as part of tube 102 or can reside independently of tube 102 as would be known to one skilled in the art. In this embodiment, the resulting recesses (grooves) 114 reside within first surface 106. The base of groove 114 can be placed in communication with hollow portion 104 of tube 102 through portal 112, all of which may be of similar or dissimilar sizes, to provide a negative differential pressure, ΔP, in a more direct manner to a web substrate passing over portal 112, the web being further supported by ridge 118. As shown in the cross-sectional view of FIG. 11, ridge 118 may have parallel edges that may be parallel to the machine direction. "Machine direction" is the direction of flow of a web substrate through the apparatus acting upon the web substrate. Further, ridge 118 may have a rounded leading edge 105 to reduce adverse web substrate contact with a potentially sharp leading edge. An additional embodiment can include additional groove 116 residing within second surface 108. The base of groove 116 can then be placed in communication with the hollow portion 104 of tube 102 through portal 113 to provide a negative differential pressure, ΔP, in a more direct manner to a web substrate passing over portal 113 and its associated relief, further supported by ridge 120. Thus, a web substrate 122 as shown in FIG. 12 moves toward rail 100 and initially contacts support ridge 118. A vacuum applied from hollow space 104 through adaptor 117 causes suction to occur through portal 112 and into groove 114 creating a negative differential pressure, ΔP. This negative differential pressure, ΔP, causes loose particulate matter on web substrate 122, in the form of loose web substrate, debris, or loose applied coating, to be removed from web substrate 122 and drawn into groove 114 and portal 112 into hollow portion 104 of hollow tube 102 prior to contact by web substrate 122 with folding edge 110. Alternatively, groove 116 can be fanned into second surface 118 and portal 113 providing communication with hollow portion 104 of tube 102 to further remove any remaining loose particulate, debris, or substrate 124 from web substrate 122 after contact with folding edge 110. Further, portals 112, 113 can be formed into any location on surfaces 118, 120 to provide acceptable efficacious removal of any loose substrate, debris, or coating from web substrate 122.

Figure 10:
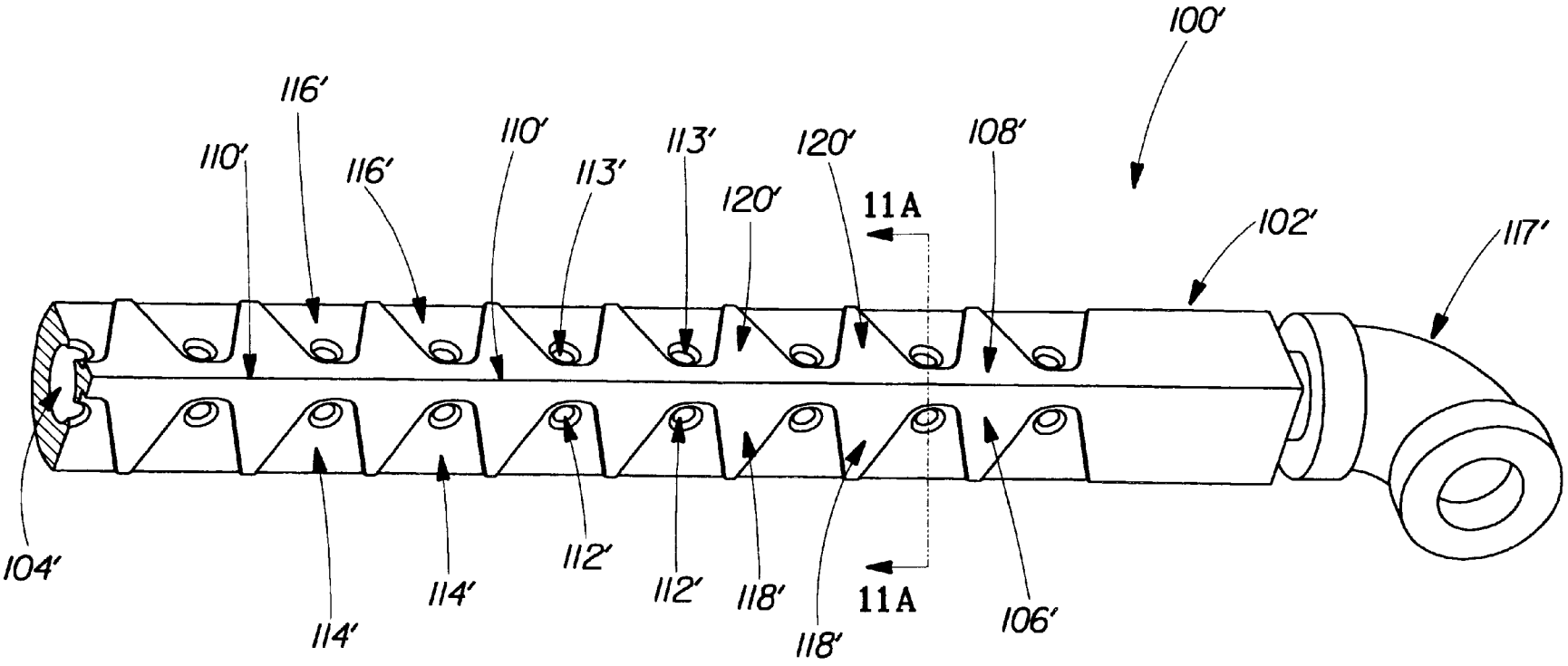
FIG. 10 is a fragmentary perspective view of another embodiment of a vacuum folding rail.

In another alternative embodiment as shown in FIG. 10, a fragmentary view of folding rail 100' depicting an elongate tube 102' having a first planar surface 106' parallel to the longitudinal axis of tube 102', a second planar surface 108' parallel to the longitudinal axis of tube 102' thereby forming folding edge 110' parallel to the longitudinal axis of tube 102'. The base of groove 114' can be placed in communication with hollow portion 104' of tube 102' through portal 112' to provide a negative differential pressure, ΔP, in a more direct manner to a web substrate passing over portal 112'. The web substrate is further supported by ridge 118' as can also be shown in the cross-sectional view of FIG. 11 as ridge 118. Ridge 118' can be parallel to the machine direction and taper inwardly toward portal 112' from first surface 106' and has a rounded leading edge 105' to further reduce detrimental contact with a web substrate. An additional embodiment can include additional groove 116' residing within second surface 108'. The base of groove 116' can then be placed in communication with hollow portion 104' of tube 102' through portal 113' to provide a differential pressure, ΔP, through adaptor 117' in a more direct manner to a web substrate passing over portal 113'. The web can be further supported by ridge 120'. Thus, a web substrate 122 as shown in FIG. 12 can move toward rail 100 and initially contact support ridge 118. A vacuum applied from hollow space 104 flows through portal 112 and into groove 114 creating a negative differential pressure, ΔP. This negative differential pressure, ΔP, causes loose particulate matter on web substrate 122, in the form of loose web substrate, debris, or loose applied coating, to be removed from web substrate 122 and drawn into groove 114 and portal 112 into hollow portion 104 of hollow tube 102 prior to contact by web substrate 122 with folding edge 110. Alternatively, groove 116 can be formed into second surface 120 so that portal 113 provides communication with hollow portion 104 of tube 102 to remove loose substrate 124 from web substrate 122 after contact with folding edge 110.

Figure 10A:
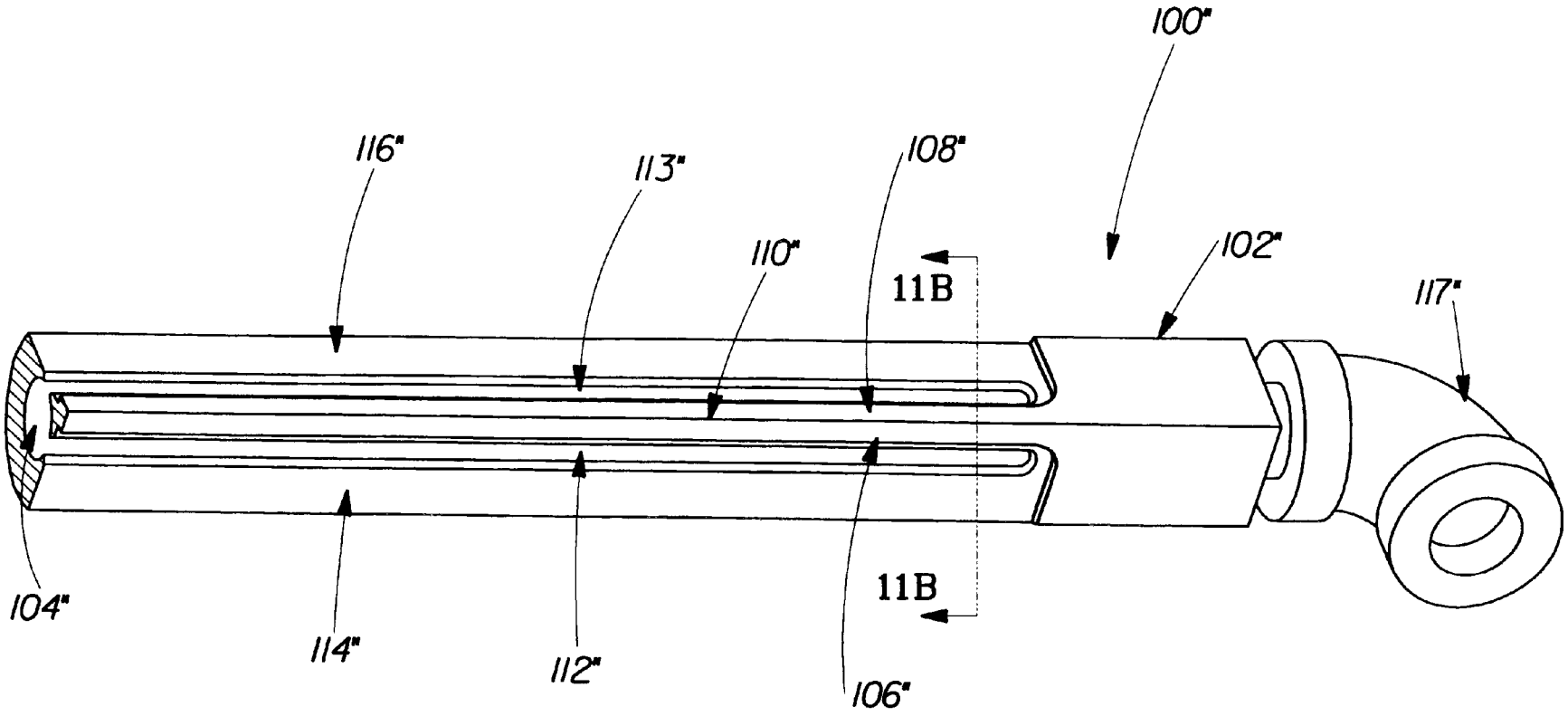
FIG. 10A is a fragmentary perspective view of another embodiment of a vacuum folding rail.
Figure 11A:
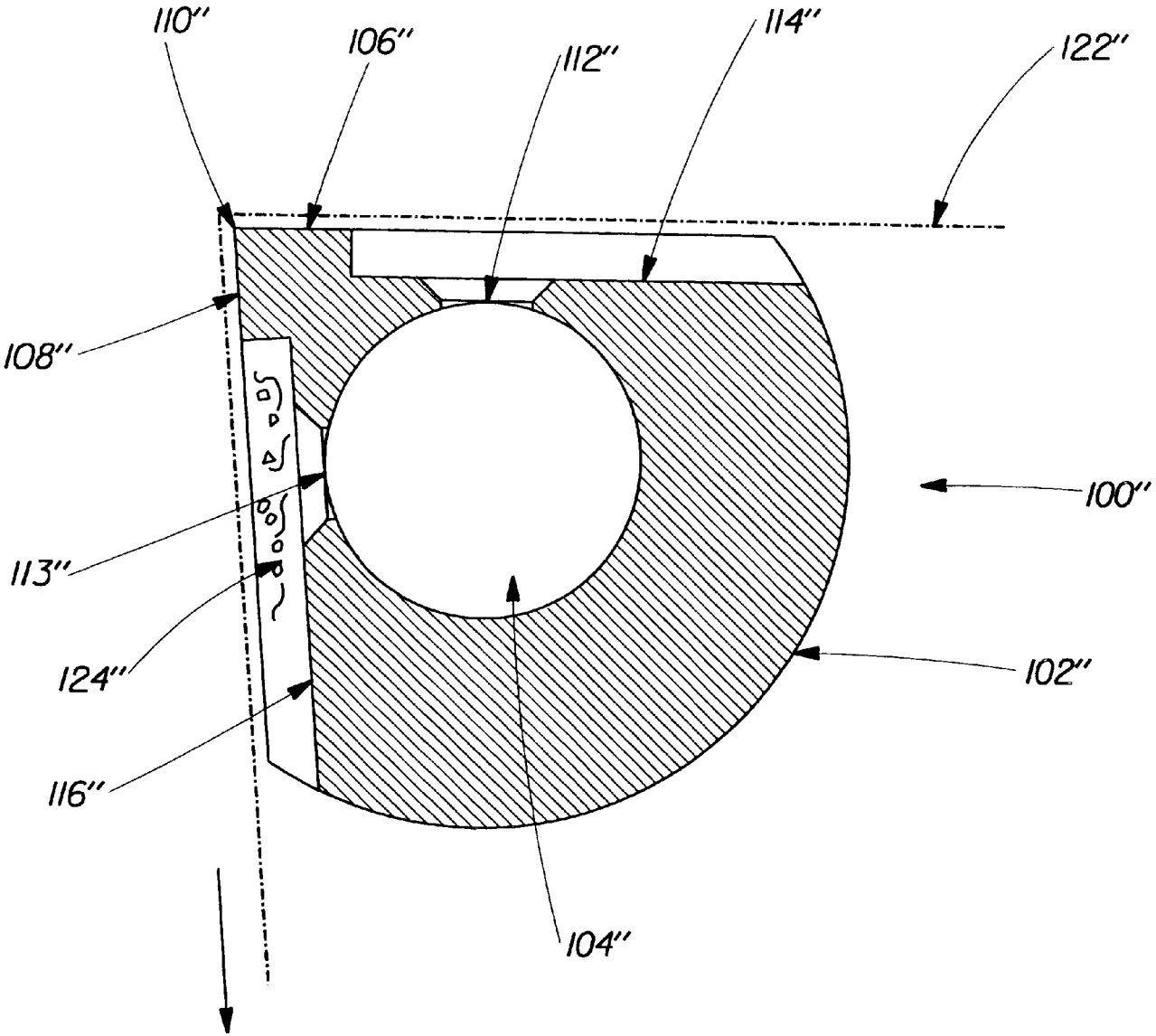
FIG. 11A is a cross-sectional view of the vacuum folding rail of FIG. 10 taken along the line 11A—11A.

In still another alternative embodiment as shown in FIG. 10A, a fragmentary perspective view of folding rail 100" depicting an elongate tube 102" having a first planar surface 106" parallel to the longitudinal axis of tube 102", a second planar surface 108" parallel to the longitudinal axis of tube 102" thereby forming an edge 110" parallel to the longitudinal axis of tube 102". The first planar surface 106", second planar surface 108" and edge 110" can be machined as part of tube 102" or reside independently of tube 102" as would be known to one skilled in the art. In this embodiment, lower surface 114" is machined lower than first surface 106". The base of lower surface 114" can then be placed in communication with hollow portion 104" of tube 102" through slot 112" to provide a negative differential pressure, ΔP, through adaptor 117" in a more direct manner to a web substrate passing over slot 112" as can also be shown in the cross-sectional view of FIG. 11A. The embodiment of FIG. 10A does not have ridges as discussed previously, thus, further reducing contact with a web substrate. The base of secondary surface 116" can then be placed in communication with the hollow portion 104" of tube 102" through an opening 113" to provide a negative differential pressure, ΔP, to a web substrate passing over the opening. Thus, web substrate 122" as shown in FIG. 11A moves toward rail 100" and initially surface 106". A vacuum applied through adaptor 117" to hollow space 104" flows through portal opening 112" to surface 114" creating a negative differential pressure, ΔP. This negative differential pressure, ΔP, causes loose particulate matter on web substrate 122", in the form of loose web substrate or loose applied coating, to be removed from web substrate 122" and drawn into portal opening 112" and into hollow portion 104" of hollow tube 102" prior to contact by web substrate 122" with folding edge 110". An additional embodiment can include an additional surface 116" machined to be lower than second surface 108". The base of lower surface 116" can then be placed in communication with the hollow portion 104" of tube 102'" through portal 113" to provide a negative differential pressure, ΔP, to a web substrate passing over portal 113". This negative differential pressure, ΔP, causes loose particulate matter on a passing web substrate 124", in the form of loose web substrate or loose applied coating, to be removed from the web substrate and drawn toward lower surface 116" and through portal opening 112" into hollow portion 104" of hollow tube 102" after contact by the web substrate with folding edge 110" to further remove any remaining particulate for product quality improvement.

Figure 10B:
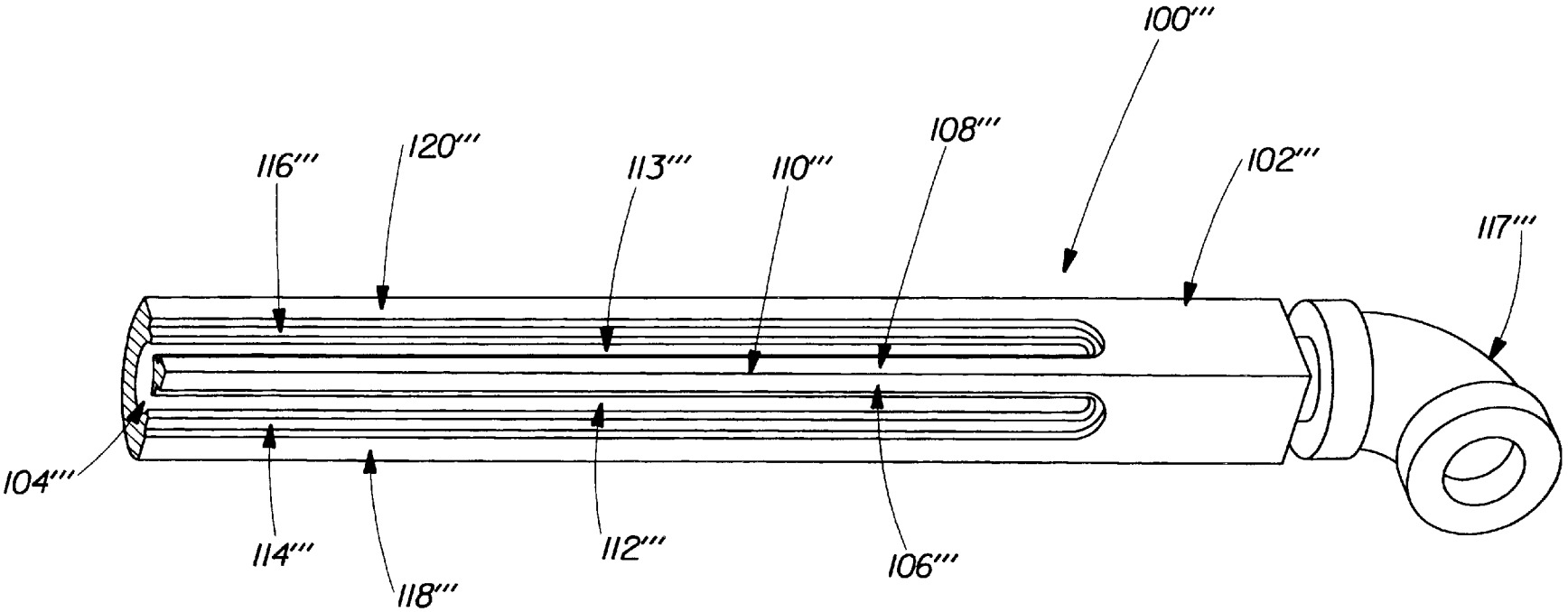
FIG. 10B is a fragmentary perspective view of another embodiment of a vacuum folding rail.
Figure 11B:
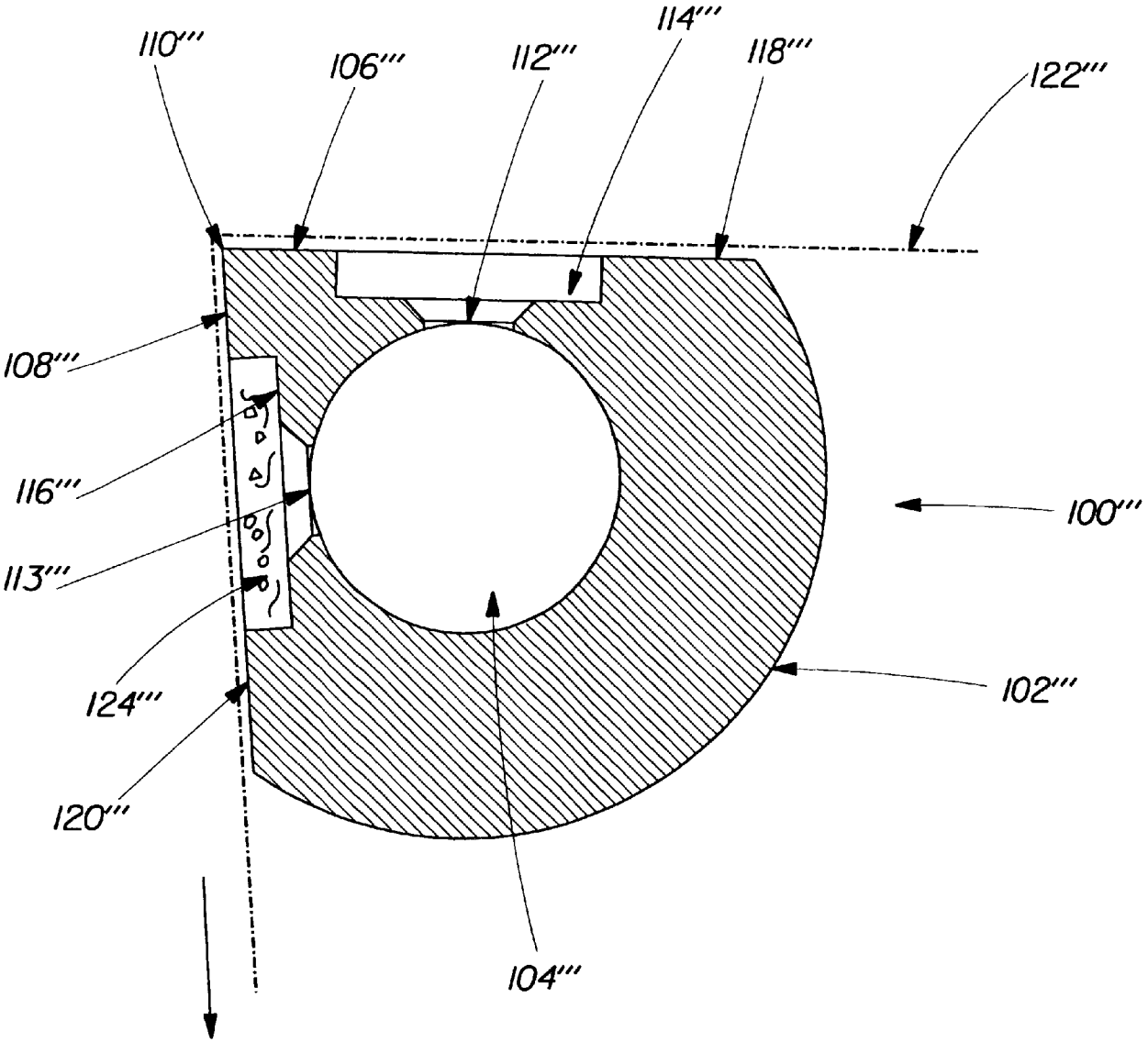
FIG. 11B is a cross-sectional view of the vacuum folding rail of FIG. 10B taken along the line 11B—11B.

In another alternative embodiment as shown in FIG. 10B, a fragmentary view of folding rail 100'" depicting an elongate tube 102'" having a first planar surface 106'" parallel to the longitudinal axis of tube 102'", a second planar surface 108'" parallel to the longitudinal axis of tube 102'" thereby forming an edge 110'" parallel to the longitudinal axis of tube 102'". The first planar surface 106'", second planar surface 108'" and edge 110'" can be machined as part of tube 102'" or reside independently of tube 102'" as would be known to one skilled in the art. In this embodiment, a relief groove 114'" resides within first surface 106'". The base of relief groove 114'" can then be placed in communication with hollow portion 104'" of tube 102'" through portal 112'" to provide a negative differential pressure, ΔP, in a more direct manner to a web substrate 122'" passing over portal 112'". Alternatively, portal 112'" can pass directly through first surface 106'". Web substrate 122'" can then be further supported by ridge 118'" as shown in the cross-sectional view FIG. 11B. An additional embodiment can include additional relief groove 116'" residing within second surface 108'". The base of relief groove 116'" can then be placed in communication with the hollow portion 104'" of tube 102'" through portal 113'" to provide a negative differential pressure, ΔP, in a secondary manner to a web substrate passing over portal 113'". Thus, a web substrate as shown in FIG. 11B can move toward rail 100'" and initially contacts support ridge 118'". A vacuum applied through adaptor 117'" to hollow space 104'" creates a suction through portal 112'" and into relief groove 114'" creating a negative differential pressure, ΔP. Additionally, relief groove 116'" can be formed into second surface 120'" and portal slot 113'" to provide communication with hollow portion 104'" of tube 102'" to remove any remaining loose particulate or loose web substrate 124'" from the web substrate after contact with edge 110'".

Figure 13:
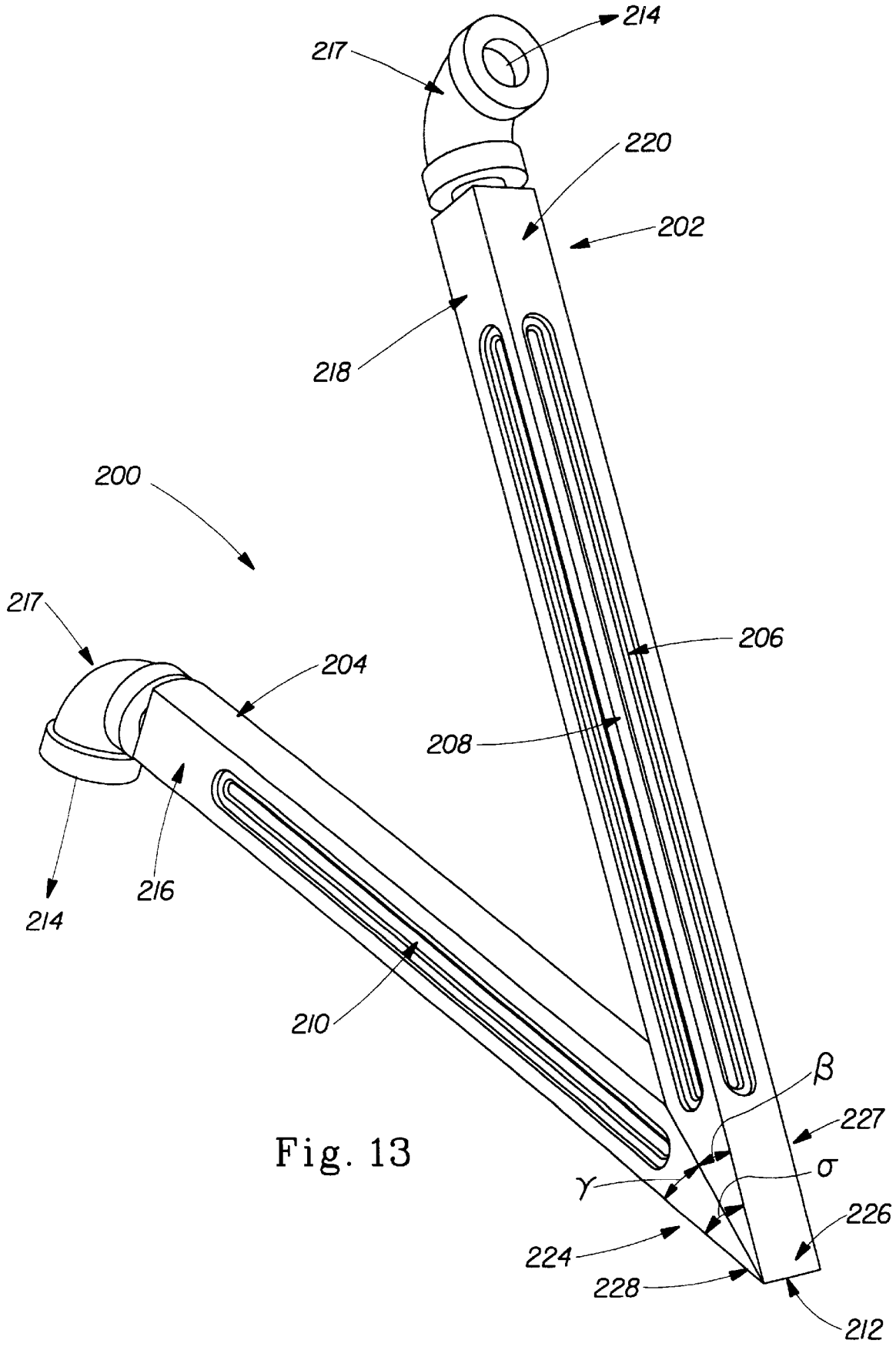
FIG. 13 is a perspective view of a preferred embodiment of a vacuum folding rail system.
Figure 14:
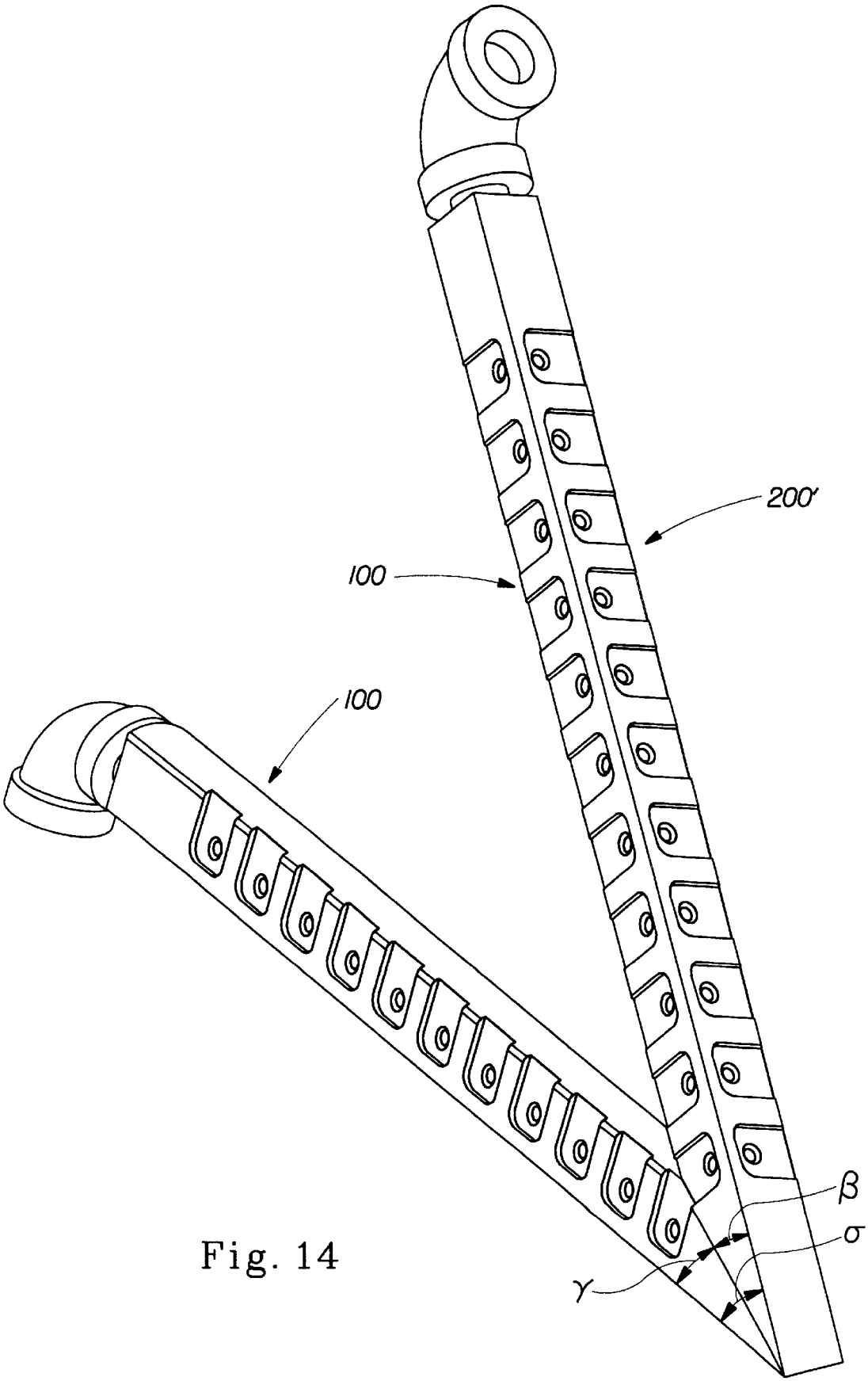
FIG. 14 is a perspective view of an alternative embodiment of a vacuum folding rail system.
Figure 15:
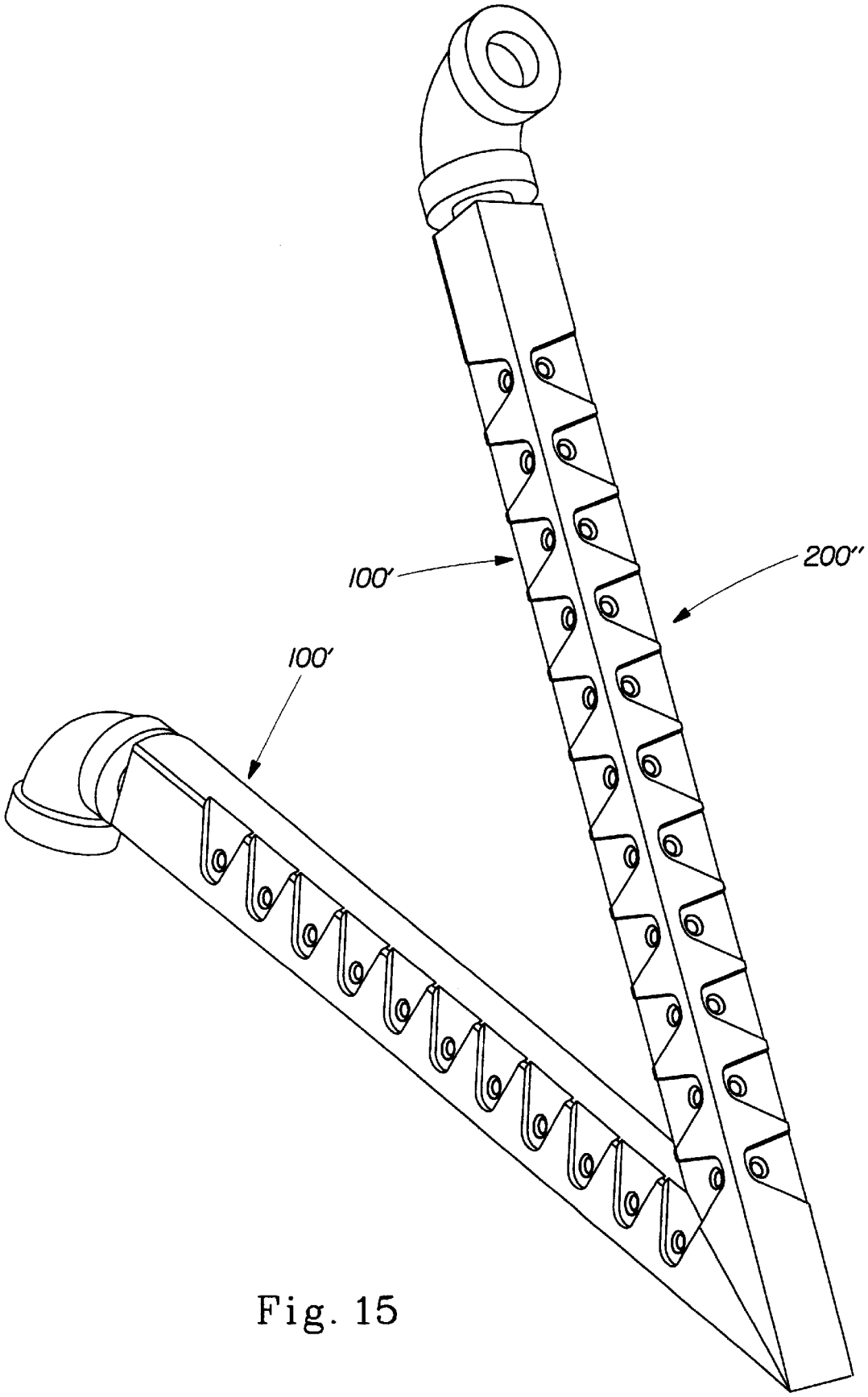
FIG. 15 is a perspective view of an alternative embodiment of a vacuum folding rail system.
Figure 15A:
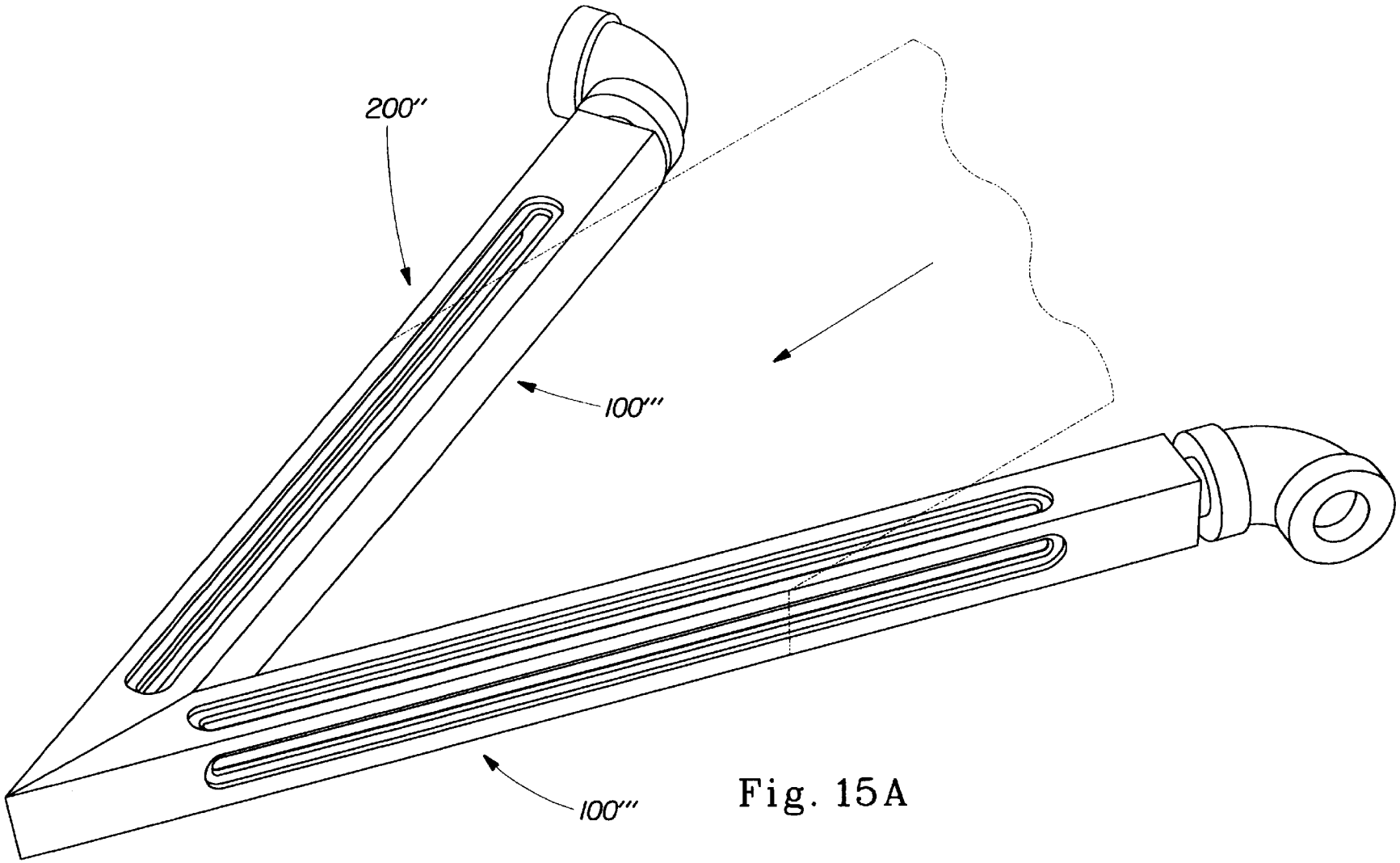
FIG. 15A is a perspective view of an alternative embodiment of a vacuum folding rail system with a web substrate material being folded.

In yet another embodiment as shown in FIG. 13, folder 200 is provided with a tandem of folding rails 202, 204. Each folding rail can be provided in accordance with the disclosure addressed supra. As shown in this embodiment, folding rails 202 and 204 each have a first surface, 218 and 216 respectively, and second surface 220 (not shown for rail 204). In a preferred embodiment a plurality of slots 206, 208, 210 are disposed on the first and second surfaces of both rails 202, 204. A vacuum 214 can be applied to each rail 202, 204 according to the disclosure of the present invention. Distal ends 222 and 224 of rails 202 and 204, respectively, taper to edges 226, 228. Edges 226, 228 of rails 202 and 204 are joined to form a vertex 212 that forms a "V"-folder according to the present invention. It should be realized by one skilled in the art that angle β of rail 202 and angle γ of rail 204 can be individually adjusted to form the desired angle σ from equal or unequal angles β and γ. Angles β and γ can be mirror images and distal ends 222 and 224 of rails 202 and 204 can be fixably positioned relative to each other. Additional embodiments of folder 200 are shown in FIGS. 14 and 15. As shown in FIG. 14, a pair of vacuum folding rails 100 as shown in FIG. 9 are combined to produce system 200'. In FIG. 15 a pair of vacuum folding rails 100' as shown in FIG. 10 are combined to produce system 200". Likewise, in FIG. 15A, a pair of vacuum folding rails 100'" as shown in FIG. 10B are combined to produce system 200'". It should be realized by one skilled in the art that any of the aforementioned vacuum folding rails can be combined to produce the desired folding structure and to provide the most efficacious removal of loose web substrate coating or web substrate.

EXAMPLES

The following numbered examples describe non-limiting exemplary vacuum folding rails and folders consistent with the scope and spirit of the present invention.

Methodology

Generally, the following process can be used to design a folding rail system. Utilizing equal path folding calculations, determine the style of vacuum folder desired. Once the fold paths are known, the physical parameters of the folder should be finalized. Additionally, one should obtain a relative estimate or obtain data that quantifies the amount and size of particulates to be removed from the incoming web substrate.

Once the particulate information is ascertained, the vacuum port configuration should be conceptualized to include air velocities necessary to transport the loose particulate, debris, or loose substrate fibers away from the web substrate. Optionally, a prototype can be constructed to confirm the required configuration and air velocities. Modification of the porting configuration may be required, and influenced, by the particulate to be removed, the type of web substrate, and the substrate velocity. This data should be incorporated into a final mechanical design. Additionally, pipe and/or tubing stock dimensions that can provide adequate internal diameters to produce the desired vacuum should be incorporated into the final design.

When the desired mechanical design is finalized, various machining processes can be incorporated to transform the stock material into having the desired folding edge, vacuum ports and mounting systems. Non-limiting examples of machining process include lathe turning, planer milling and slot cutting, gun drilling, and CNC metal removing methods such as EDM (electro discharge machining), "plunge" and wire cut machines, CNC milling and CNC water jet cutting. All machined parts and the finalized assembly can be tested using non-limiting methods such as coordinate measurement machines, optical comparators and three-dimensional paper web models. Typical assemblies are generally within 0.002 to 0.005 inches (0.005 centimeters to 0.013 centimeters) in parallelism and perpendicularity to the overall machine centerline and the incoming web substrate.

Example 1

Figure 16:
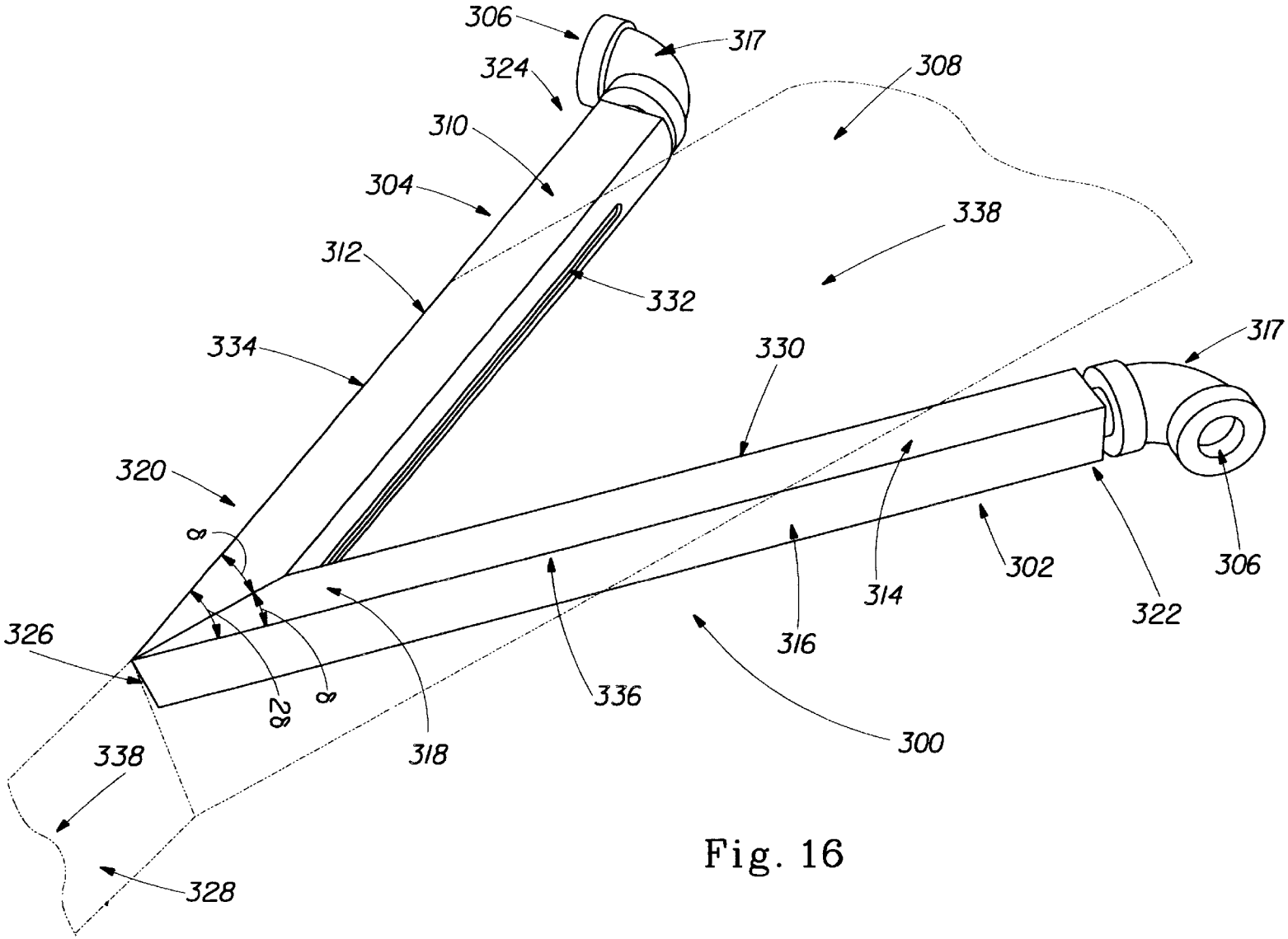
FIG. 16 is a perspective view of a preferred embodiment of a vacuum folding rail system with a web substrate material being folded; and, FIG. 17 is a perspective view of another embodiment of a vacuum folding rail system with a web substrate material being folded.

An exemplary process for forming a "V" fold in any direction, utilizing an equal path folder 300 for the removal of loose substrate, debris, or coating materials from a moving web substrate is shown in FIG. 16. In a preferred embodiment, folder 300 comprises at least two vacuum rails 302, 304 that comprise first and second surfaces 314, 310 and 316, 312 respectively and have proximal and distal ends 322, 324 and 318, 320 respectively. Both rails preferable have vacuum orifices 330, 332 respectively. Both vacuum rails subtend an angle δ at their respective distal ends 318, 320. The distal ends of both rails 302, 304 are joined to form edge 326 with a total angle of 2δ.

More particularly, a "V"-folder was constructed of ⅞ inch (2.22 centimeter (cm)) outside diameter, schedule 80, 304 stainless steel pipe (SST). A "long rail" and a "small rail" were manufactured in order to accommodate more web on one side of the "V" than the other, however construction of either the "long" or "small" rails are identical for this embodiment. The "long" and "small" rails measured 16.56 inches (42.1 cm) and 14.39 inches (36.6 cm) in length, respectively.

Pipe concentricity was checked using common centers. Acceptable total indicated run-out (T.I.R.) was determined to be within +/−0.010 inch (0.025 cm) for the base rough material. Material outside this tolerance was rejected. Acceptable stock was then inspected to notice any other defects that could be machined off later or cause rejection of that particular stock. The distal and proximal ends were then selected as well.

The inside diameter of the proximal end was then turned in a lathe to produce a smooth finish with a 0.578 inch (1.47 cm) diameter, to provide the correct diameter for ⅜ inch (0.95 cm) national pipe thread (NPT). The proximal end was threaded using a ⅜ inch (0.95 cm) NPT pipe tap. This allows for a screwed pipe connection to the vacuum system.

The inside diameter (ID) of the distal end of the stock was then turned to a depth of approximately 2 inches (5.08 cm) to provide a smooth ID and a small "shoulder or step" in which a subsequent solid stainless steel plug can be press fit into securely. A solid round piece of 304 SST bar, approximately 1 to 2 inches (2.5 to 5.1 cm) long, was turned to provide a 0.003 to 0.005 inch (0.008 to 0.013 cm) over size OD over that of the previously machined ID to obtain a "press fit plug" with the distal end rail. This was done with both rails. A plug was then pressed into the distal end of each rail. A sealant was used to provide a leak-proof fit.

"Flats" were then machined onto the rails according to precise engineering detail drawings. A "mounting flat" was machined onto the selected non-web side of the rail. This was denoted as the "underside" of the rail. A series of #10–24 mounting screw holes were then tapped into the remaining wall perpendicular to the previously machined flat. Mounting holes were located at proper locations for a predetermined mounting bracket, and were only tapped into the "near wall" and not beyond the internal bore.

According to the predetermined fold geometry another flat was machined 180 degrees radially from the "mounting flat" into the stock. The final pass of this machining process provided a 63-root mean squared (RMS) surface finish or better. This is the primary or first planer surface in contact with the web substrate to be folded. According to the folder geometry, a third "flat" surface is machined into the stock, adjacent to the previous flat. The edge generated by this secondary flat surface with the previous flat, created the "folding edge". Therefore, the surface finish was also at least 63 RMS, or better.

The rail was then "set-up" in a computer numeric controlled (CNC) machine to locate the relationship between the folding edge and the proposed "nose angle". One-half of the proposed angle was machined into the distal end of each rail.

The vacuum orifice was then located and set-up to create a ¼ inch (0.635 cm) wide slot starting at the proximal end and continuing to within ½ inch (1.27 cm) of the distal end of the rail and either widening to ⅜ inch (0.95 cm), or staying continuous in width. This slot was machined into one wall and did not go beyond the bore of the rail. Alternatively, a long drill can be used to create the inside diameter described above into a solid bar of material.

A vacuum source 306 is applied to each rail 302, 304 as web substrate 308, under tension, passes proximate to the first surface of each rail 314, 310 over edges 334, 336 and second surfaces 316, 312. Web substrate 308 then converges toward the distal end in direction 338 of each rail 318, 320 toward edge 326. After passing edge 326, the final "V"-fold resultant 328 emerges from the folding system 300. The resultant is then processed through two pinch rollers (not shown) to produce the final "V" folded product.

Example 2

Figure 17:
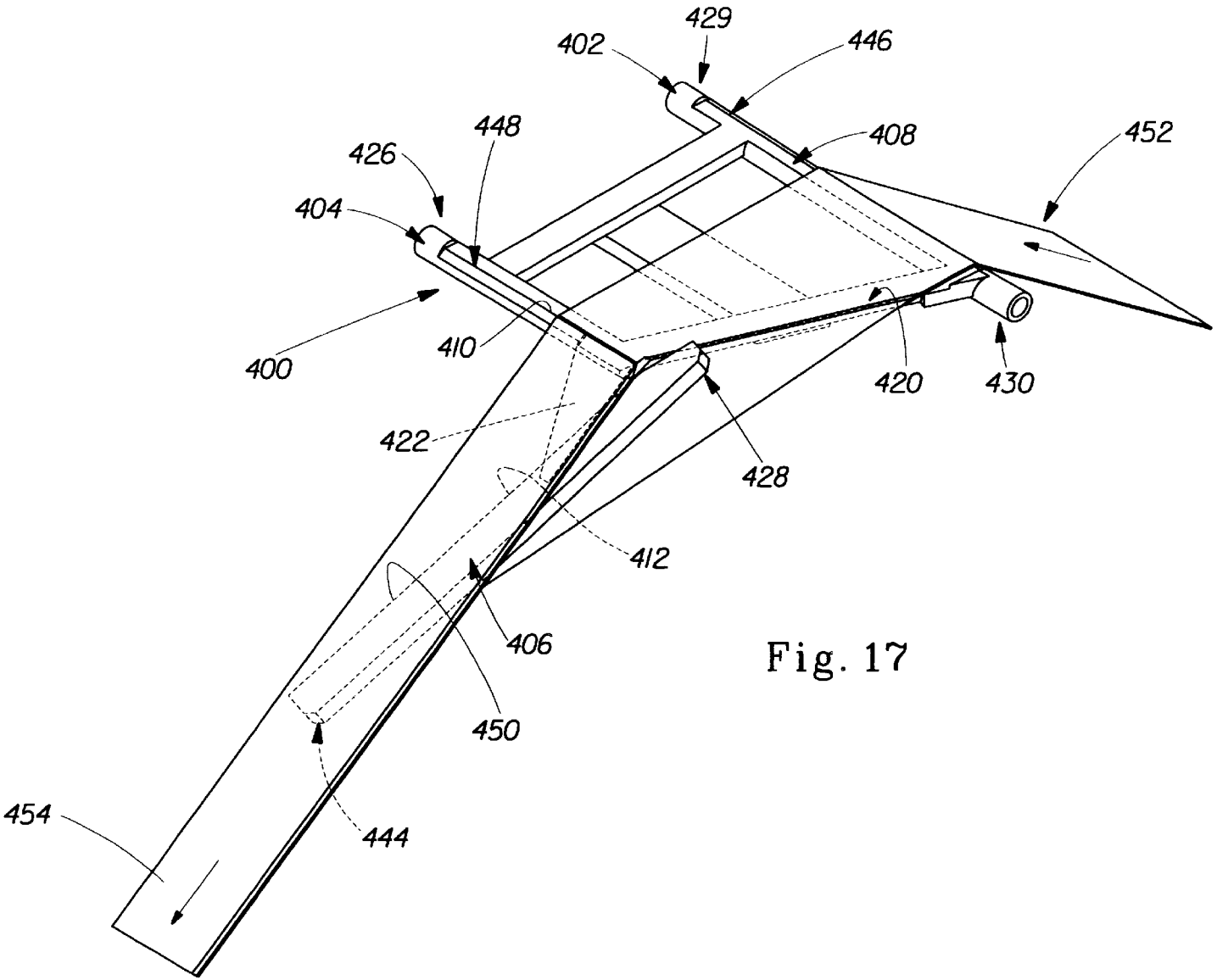

Another exemplary process for forming a "C"-fold utilizing an equal path folder 400 for the removal of loose substrate, debris, or coating materials from a moving web substrate is shown in FIG. 17. Equal path folder 400 comprises at least three vacuum rails 402, 404, 406 (partially shown). Each rail is formed according to the methodology presented in Example 1. Each folding rail 402, 404, 406 has first surfaces 408, 410, 412. Rails 402, 404, 406, 420 are configured as a set to detour an incoming web substrate, thus forming the desired equal path length required for producing a flat "C" fold. In addition, fourth and fifth rails 420 (partially shown), 422 (partially shown) can be used to complete the "C" folded geometry. In FIG. 17, rails 420, 422 are not shown with vacuum cleaning ability, however, a vacuum source can be so included as would be known to one skilled in the art.

A vacuum source can be applied to the proximal end 424, 426, 428 of each folding rail 402, 404, 406 respectively. However, it should be noted that either the proximal end 424, 426, 428 or distal ends 430, 444 of rails 402, 404, 406 respectively, can be used for connection to the vacuum source. Additionally, different vacuum sources, or adjustable vacuum sources can be used to provide different differential pressures within each folding rail. A web substrate 452 passes under tension and proximate to the first surface 408, 410, 412 of each rail 402, 404, 406 and over the edges 446, 448, 450 of each respective rail 402, 404, 406 and rails 420, 422, wherein loose substrate, debris, or coating are removed by the vacuum source as described supra. Detours encountered by the web substrate due to rails 402, 404, 406 and edges 446, 448, 450 impart the desired resulting "C" fold as the web product 454 finally emerges from the folding system.

Example 3

In another example, "V"-fold vacuum cleaning rails, for the removal of loose substrate, debris, or coating materials from a moving web substrate, are re-applied as separate subassemblies to complete a dual side "Z"-fold or a single side "Z"-fold process. The first "V"-fold subassembly is labeled as a "truncated" inlet section and the second "V"-fold subassembly is labeled the "resultant plow" section. Additional cross machine direction vacuum cleaning folding rails can be utilized to form the first and second break lines of the "Z"-folder assembly as was done with rail 402 of the "C"-fold as described in Example 2 and shown in FIG. 17. Optionally, cross machine direction vacuum cleaning folding rails can be used to "set the fold" as a definer at the exit line of the folding process as well.

Such an exemplary apparatus for equal path "Z"-folder comprises nine vacuum cleaning folding rails. This exemplary embodiment has vacuum cleaning folding rails manufactured as described in any of the embodiments described supra. Each vacuum cleaning folding rail is produced with proximal ends and distal ends. All rails are equipped with vacuum orifices manufactured in accordance with the disclosure in Example 1 above.

The "truncated inlet" rails are configured same as the above described "V"-fold as described in Example 1 above. However, except the "truncated inlet" rails are truncated prior to their final convergence. At the desired truncation point, a "midpoint breaking rail" is located in the cross web or in the machine direction. Additionally, a "transition point" is located at the junction of the "midpoint breaking rail" and the distal end of the aforementioned "truncated inlet" rails. A "transition point" can optionally be located at both ends of the midpoint breaking cross rail, as would be known to one skilled in the art, when the dual side "Z"-fold is used.

Regardless of whether one or two transition points are used, a miniaturized version of the original "V"-fold vacuum cleaning rails is mounted externally, forming the proper compound angle to detour the exiting web substrate into the desired "Z" form. A "fold set" rail is then advantageously positioned at the convergence point or end of the "resultant plow" subassembly. The "fold set" rail is located parallel to the midpoint breaking rail, with minimal clearance from the aforementioned resultant "V"-folding rail subassembly.

A vacuum source can be applied to each individual vacuum cleaning folding rail. If vacuum is applied, application is typically at the proximal ends of each folding rail. However, it would be possible by one skilled in the art to locate the vacuum source at either the proximal or distal end of each folding rail, or even in a middle portion of each rail as would be required by the fold geometry and spatial constraints. Additionally, different vacuum sources, or adjustable vacuum sources can be used to provide different differential pressures within each folding rail.

With all the aforementioned rails positioned properly, in equal path geometry, the incoming web substrate is detoured into the desired flat "Z"-fold or double "Z"-fold with minimal loose particulate matter present on the exiting web substrate, thus providing a vacuum cleaning "Z"-fold embodiment.

As would be known to one skilled in the art, similar constructs may be constructed to perform any number of folding systems or folding patterns. Without attempting to be limiting, the present invention can be used to present inverted "C"-folds, rectangular over wrap folds, "M"-, "W"-, "U"-folds, and the like.

The foregoing examples and descriptions of the preferred embodiments of the invention have been presented for purposes of illustration and description only. They are not intended to be exhaustive or to limit the invention to the precise forms disclosed, and modifications and variations are possible and contemplated in light of the above teachings. While a number of preferred and alternate embodiments, systems, configurations, methods, and potential applications have been described, it should be understood that many variations and alternatives could be utilized without departing from the scope of the invention.

Thus, it should be understood that the embodiments and examples above have been chosen and described in order to best illustrate the principles of the invention and its practical applications to thereby enable one of ordinary skill in the art to best utilize the invention in various embodiments and with various modifications as are suited for the particular uses contemplated. Accordingly, it is intended that such modifications fall within the scope of the invention as defined by the claims appended hereto.

What is claimed is:

1. An elongate rail for an equal path folder comprising:

a hollow tube having a longitudinal axis;

said tube having a vacuum applied thereto;

said tube having a first substantially planar surface parallel to said longitudinal axis;

said first surface comprising at least two planes and defining a first protuberance and a first recess;

said tube having a second substantially planar surface parallel to said longitudinal axis;

said first surface and said second surface forming an edge therebetween;

at least one opening disposed on said first recess;

said vacuum causing a negative pressure to be applied to said opening so that a web substrate passing over said first surface has at least a portion of said vacuum applied to a face of said web substrate when said web substrate contacts said first surface.

2. The elongate rail of claim 1 wherein said opening is located in a position so that said vacuum is applied to said web substrate prior to said web substrate contacting said protuberance.

3. The elongate rail of claim 1 wherein said second surface comprises at least two planes. said second surface defining a second protuberance.

4. The elongate rail of claim 3 wherein said second surface further defines a second recess, said second recess having at least one opening disposed thereon and wherein said vacuum causes a negative pressure to be applied to said opening disposed upon said second recess so that a web substrate passing over said second surface has at least a portion of said vacuum applied to a face of said web substrate when said web substrate is proximate to said second surface.

5. The elongate rail of claim 4 wherein said opening disposed upon said second recess is located in a position so that said web substrate contacts a portion of said vacuum after contact with said protuberance.

6. The elongate rail of claim 3 wherein said first protuberance and said second protuberance form an edge parallel to said longitudinal axis therebetween.

7. The elongate rail of claim 3 wherein said second protuberancefurther comprises at least one support member positioned externally away from said second surface and parallel to the direction of flow of said web substrate.

8. An equal path folder comprising:

at least two elongate rails, each of said rails comprising:

a hollow tube having a longitudinal axis, a proximal end, a distal end, and a vacuum applied thereto;

each of said tubes having a first substantially planar surface parallel to said longitudinal axis;

each of said tubes having a second substantially planar surface parallel to said longitudinal axis;

each of said first surfaces and said second surfaces forming an edge therebetween;

at least one opening in each of said tubes, said opening not being disposed on said first or said second surfaces;

wherein each said first surface is angularly convergent upon said respective second surface at said distal end to forming an edge therebetween; and, said vacuum causing a negative pressure to be applied to said opening so that a web substrate passing over said first and second surfaces has at least a portion of said vacuum applied to a face of said web substrate when said web substrate contacts at least one of said first and second surfaces; and, wherein said distal end of said first elongate rail is fixably positioned relative to said distal end of said second elongate rail, said distal end of said first elongate rail and said distal end of said second elongate rail forming a vertex therebetween.

9. The equal path folder of claim 8 further comprising:

a vacuum source in communication with the proximal end of said first and second elongate rails.

10. The equal path folder of claim 8 further comprising a second opening in said tube angularly positioned away from said first and said second surfaces and in communication with said vacuum.

11. The equal path folder of claim 8 wherein a first of said at least two elongate rails is a mirror image of a second of said at least two elongate rails.

12. An elongate rail for an equal path folder comprising:

a hollow tube having a longitudinal axis;

said tube having a vacuum applied thereto;

said tube having a first substantially planar surface parallel to said longitudinal axis;

said first surface comprising at least two planes and defining a first protuberance and a first recess;

said tube having a second substantially planar surface parallel to said longitudinal axis;

said second surface comprising at least two planes and defining a second protuberance and a second recess;

said first surface and said second surface forming an edge therebetween;

at least one opening disposed on said first recess of said first surface;

at least one opening disposed on said second recess of said second surface; and, said vacuum causing a negative pressure to be applied to said at least one opening disposed on said first recess and said at least one opening disposed on said second recess so that a web substrate passing over said first surface and said second surface has at least a portion of said vacuum applied to a face of said web substrate when said web substrate is proximate to said first surface and said second surface.

13. The elongate rail of claim 12, said first opening disposed on said first recess is located in a position so that said vacuum is applied to said web substrate prior to said web substrate contacting said protuberance.

14. The elongate rail of claim 12, wherein said opening disposed on said first surface is located in a position so that said web substrate contacts a portion of said vacuum after contact with said protuberance.

15. The elongate rail of claim 12, wherein said first protuberance further comprises at least one support member positioned externally away from said first surface and parallel to the direction of flow of said web substrate.

16. The elongate rail of claim 15, wherein said second protuberance further comprises at least one support member positioned externally away from said second surface and parallel to the direction of flow of said web substrate.

17. The elongate rail of claim 1, wherein said first protuberance further comprises at least one support member positioned externally away from said first surface and parallel to the direction of flow of said web substrate.

* * * * *